US012252963B2

(12) United States Patent
Dyess et al.

(10) Patent No.: US 12,252,963 B2
(45) **Date of Patent: *Mar. 18, 2025**

(54) MODULAR GUN SYSTEM

(71) Applicant: Hunting Titan, Inc., Pampa, TX (US)

(72) Inventors: Adam Dyess, Houston, TX (US); Christopher Brian Sokolove, Midlothian, TX (US); Ryan Bradley, Pampa, TX (US); Julio Cesar Veliz, Cypress, TX (US)

(73) Assignee: Hunting Titan, Inc., Pampa, TX (US)

( * ) Notice: Subject to any disclaimer, the term of this patent is extended or adjusted under 35 U.S.C. 154(b) by 334 days.

This patent is subject to a terminal disclaimer.

(21) Appl. No.: 17/757,713

(22) PCT Filed: Jun. 26, 2021

(86) PCT No.: PCT/US2021/039278

§ 371 (c)(1),
(2) Date: Jun. 18, 2022

(87) PCT Pub. No.: WO2021/263223

PCT Pub. Date: Dec. 30, 2021

(65) Prior Publication Data

US 2023/0019915 A1 Jan. 19, 2023

Related U.S. Application Data

(60) Provisional application No. 63/044,886, filed on Jun. 26, 2020.

(51) Int. Cl.

| | |
|---|---|
| ***E21B 43/117*** | (2006.01) |
| ***E21B 43/1185*** | (2006.01) |
| ***E21B 43/119*** | (2006.01) |

(52) U.S. Cl.
CPC ..... *E21B 43/117* (2013.01); *E21B 43/1185* (2013.01); *E21B 43/119* (2013.01)

(58) Field of Classification Search
CPC ..... E21B 43/11; E21B 43/119; E21B 43/116; E21B 43/117; E21B 17/208; E21B 43/1185
See application file for complete search history.

(56) References Cited

U.S. PATENT DOCUMENTS

| | | | | |
|---|---|---|---|---|
| 10,429,161 | B2 * | 10/2019 | Parks | F42D 1/043 |
| 11,174,712 | B2 * | 11/2021 | Quattlebaum | E21B 43/1185 |
| 11,391,126 | B2 * | 7/2022 | Dyess | E21B 43/117 |
| 2010/0089643 | A1 * | 4/2010 | Vidal | E21B 43/117 175/2 |
| 2016/0084048 | A1 * | 3/2016 | Harrigan | E21B 43/119 175/4.57 |
| 2018/0299239 | A1 * | 10/2018 | Eitschberger | H05K 5/069 |

(Continued)

FOREIGN PATENT DOCUMENTS

| | | | | |
|---|---|---|---|---|
| WO | WO 2919032600 | * | 2/2019 | F42B 3/182 |
| WO | 2021102384 | A1 | 5/2021 | |
| WO | 2021263223 | A1 | 12/2021 | |

*Primary Examiner* — Yong-Suk (Philip) Ro
(74) *Attorney, Agent, or Firm* — Saunders McKeon PLLC

(57) ABSTRACT

A method and apparatus for inserting a detonator into a door on an end fitting and closing the door into a recess of the end fitting, enabling a quick wireless install of a detonator and resulting in a side-by-side arrangement between the detonator and the detonating cord.

52 Claims, 22 Drawing Sheets

(56) References Cited

U.S. PATENT DOCUMENTS

| | | | | |
|---|---|---|---|---|
| 2019/0292887 | A1* | 9/2019 | Austin, II | F42D 1/05 |
| 2020/0256168 | A1* | 8/2020 | Knight | E21B 43/119 |
| 2021/0207934 | A1* | 7/2021 | Sullivan | E21B 43/1185 |
| 2021/0223007 | A1* | 7/2021 | Kash | E21B 43/1185 |
| 2023/0019915 | A1 | 1/2023 | Dyess et al. | |

* cited by examiner

MODULAR GUN SYSTEM

RELATED APPLICATIONS

This application is a national stage application of PCT/US21/39278, filed on Jun. 26, 2021, which claims priority to U.S. Provisional Application No. 63/044,886, filed Jun. 26, 2020.

BACKGROUND OF THE INVENTION

Generally, when completing a subterranean well for the production of fluids, minerals, or gases from underground reservoirs, several types of tubulars are placed downhole as part of the drilling, exploration, and completions process. These tubulars can include casing, tubing, pipes, liners, and devices conveyed downhole by tubulars of various types. Each well is unique, so combinations of different tubulars may be lowered into a well for a multitude of purposes.

A subsurface or subterranean well transits one or more formations. The formation is a body of rock or strata that contains one or more compositions. The formation is treated as a continuous body. Within the formation hydrocarbon deposits may exist. Typically a wellbore will be drilled from a surface location, placing a hole into a formation of interest. Completion equipment will be put into place, including casing, tubing, and other downhole equipment as needed. Perforating the casing and the formation with a perforating gun is a well-known method in the art for accessing hydrocarbon deposits within a formation from a wellbore.

Explosively perforating the formation using a shaped charge is a widely known method for completing an oil well. A shaped charge is a term of art for a device that when detonated generates a focused output, high energy output, and/or high velocity jet. This is achieved in part by the geometry of the explosive in conjunction with an adjacent liner. Generally, a shaped charge includes a metal case that contains an explosive material with a concave shape, which has a thin metal liner on the inner surface. Many materials are used for the liner; some of the more common metals include brass, copper, tungsten, and lead. When the explosive detonates, the liner metal is compressed into a superheated, super pressurized jet that can penetrate metal, concrete, and rock. Perforating charges are typically used in groups. These groups of perforating charges are typically held together in an assembly called a perforating gun. Perforating guns come in many styles, such as strip guns, capsule guns, port plug guns, and expendable hollow carrier guns.

Perforating charges are typically detonated by detonating cord in proximity to a priming hole at the apex of each charge case. Typically, the detonating cord terminates proximate to the ends of the perforating gun. In this arrangement, an initiator at one end of the perforating gun can detonate all of the perforating charges in the gun and continue a ballistic transfer to the opposite end of the gun. In this fashion, numerous perforating guns can be connected end to end with a single initiator detonating all of them.

The detonating cord is typically detonated by an initiator triggered by a firing head. The firing head can be actuated in many ways, including but not limited to electronically, hydraulically, and mechanically.

Expendable hollow carrier perforating guns are typically manufactured from standard sizes of steel pipe with a box end having internal/female threads at each end. Pin ended adapters, or subs, having male/external threads are threaded one or both ends of the gun. These subs can connect perforating guns together, connect perforating guns to other tools such as setting tools and collar locators, and connect firing heads to perforating guns. Subs often house electronic, mechanical, or ballistic components used to activate or otherwise control perforating guns and other components.

Perforating guns typically have a cylindrical gun body and a charge tube, or loading tube that holds the perforating charges. The gun body typically is composed of metal and is cylindrical in shape. Charge tubes can be formed as tubes, strips, or chains. The charge tubes will contain cutouts called charge holes to house the shaped charges.

It is generally preferable to reduce the total length of any tools to be introduced into a wellbore. Among other potential benefits, reduced tool length reduces the length of the lubricator necessary to introduce the tools into a wellbore under pressure. Additionally, reduced tool length is also desirable to accommodate turns in a highly deviated or horizontal well. It is also generally preferable to reduce the tool assembly that must be performed at the well site because the well site is often a harsh environment with numerous distractions and demands on the workers on site.

Electric initiators are commonly used in the oil and gas industry for initiating different energetic devices down hole. Most commonly, 50-ohm resistor initiators are used. Other initiators and electronic switch configurations are common.

Modular or "plug and play" perforating gun systems have become increasingly popular in recent years due to the ease of assembly, efficiencies gained, and reduced human error. Most of the existing plug and play systems either (1) utilize a wired in switch and/or detonator, or (2) require an initiating "cartridge" that houses the detonator, switch, electrical contacts and possibly a pressure bulkhead. The wired in switch/detonator option is less desirable, because the gun assembler must make wire connections which is prone to human error. The initiating cartridge option is less desirable because the cartridge can be a large explosive device—in comparison to a standard detonator—thus takes up additional magazine space at the user facility. There is a need for a modular perforating system in which no wire connections are required by the user AND the switch and pressure bulkhead are in pre-assembled in the gun assembly rather than in the initiating cartridge. The detonator for the proposed system has no wires and allows for simple arming by the user in the field.

SUMMARY OF EXAMPLE EMBODIMENTS

An example embodiment may include a perforating gun system comprising a cylindrical housing with a bottom end and a top end, a prewired loading tube assembly disposed within the cylindrical housing and having a corresponding bottom end and top end, an upper end fitting having a door for receiving a detonator and securing it into a recess coupled to the top end of the prewired loading tube and the top end of the cylindrical housing, a lower end fitting coupled to the bottom end of the prewired loading tube and the bottom end of the cylindrical housing, an upper electrical connections coupled to the upper end fitting, a lower electrical connections coupled to the bottom end fitting, a selective switch coupled to a detonator connector receptacle disposed within the upper end fitting, and a detonator electrically coupled to the selective switch and further disposed within the door of the upped end fitting.

An alternative embodiment may include having the upper end fitting disposed within the pre-wired loading tube houses a selective switch in which the end fitting contains a portion to receive an auto-shunting modular detonator by electrically connecting it to a mating receptacle of a selective switch and affixing the auto-shunting modular detonator proximate to a detonating cord. It may include a means for auto-shunting the detonator. It may include coupling a baffle to the bottom end of the cylindrical housing. The prewired loading tube may further include an insulated wire which is terminated at the selective switch in the upper end and a pressure bulkhead coupled to the lower end. The selective switch may be grounded to the loading tube. The loading tube may be electrically connected to the baffle. It may include having shaped charges installed into the loading tube, in which the shaped charges are held in place by a locking means fixed to the shaped charge. It may include having a detonating cord coupled to the back of the shaped charges with a detonating cord locking means. The detonating cord may be terminated into a detonating cord orifice integral with the end fitting. The detonator may be located adjacent to the detonating cord in an end-to-end configuration. The detonator may have an auto-shunting feature that does not un-shunt until a mating receptacle is inserted. The selective switch may have a ribbon pigtail with the un-shunting receptacle attached. The receptacle connected to the switch may be attached to the end of the detonator, disengaging the shunt of the detonator.

An example embodiment may include a pre-wired shaped charge loading tube assembly comprising a cylindrical housing with a bottom end and a top end, an upper end fitting having a door for electrically receiving a detonator and securing it into a recess coupled to the top end of the prewired loading tube and the top end of the cylindrical housing, a lower end fitting coupled to the bottom end of the prewired loading tube and the bottom end of the cylindrical housing, an upper electrical connections coupled to the upper end fitting, lower electrical connections coupled to the bottom end fitting, a selective switch coupled to a detonator connector receptacle disposed within the upper end fitting, and a detonator electrically coupled to the selective switch and further disposed within the door closed into the recess of the upper end fitting.

An example embodiment may include a method of perforating a wellbore comprising coupling a pre-wired first end fitting with a first end of a shaped charge loading tube, coupling a pressure bulkhead at the first end fitting and the first end of the shaped charge loading tube, coupling a pre-wired second end fitting with a second end of a shaped charge loading tube, wherein the second end fitting centers and orients the loading tube and embodies a selective switch, feed through contact and orifices to insert a wireless detonator from the outer end and detonating cord into the inner end, inserting a detonator into a door incorporated into end fitting and closing the door into a recess of the end fitting such that the explosive end of the detonator is adjacent to the detonating cord in an side-by-side configuration, and prewiring the loading tube with insulated wire, wherein the wire is terminates at the selective switch in the second end fitting and the pressure bulkhead at the first end fitting.

An alternative embodiment may include centering the loading tube using the first end fitting within a perforating gun body. It may include electrically contacting the preinstalled insulated wire disposed within the loading tube to the pressure bulkhead contact adjacent. It may include pre-installing the baffle in the pin end of the gun carrier. It may include grounding the selective switch to the shaped charge loading tube. It may include inserting the shaped charges into the shaped charge loading tube. It may include locking the shaped charges into place within the shaped charge loading tube. It may include inserting detonating cord into the back of each shaped charge disposed within the shaped charge loading tube via locking features fixed to the shaped charge. It may include inserting the termination of a detonating cord into the end fitting. It may include inserting a wireless detonator into the end fitting from outside of the perforating gun assembly such that the explosive load end of the detonator is adjacent to the detonating cord in an end to end position. The wireless detonator may have an auto-shunting feature that does not un-shunt until a mating receptacle is inserted. The selective switch may have a ribbon pigtail with the un-shunting receptacle attached. It may include inserting the wireless detonator wherein the connector receptacle connected to the switch is attached to the end of the detonator, disengaging the shunt of the detonator. It may include screwing together the loaded perforating modular gun assemblies wherein the top contact makes electrical contact to the bottom contact of the adjacent gun assembly. It may include swaging and threading the outer diameter of a pin end of the perforating gun. It may include installing a pin by pin tandem sub into a box end of perforating gun assembly having a box by box gun body. It may include selectively initiating the detonator of the perforating gun. It may include pre-assembling spring-loaded top contact wires coupled to the selective switch. It may include connecting the through wire of the selective switch to the insulated wire of the loading tube. The output wires of the selective switch may be insulated ribbon or wires which has the detonator connector receptacle affixed to its end. It may include inserting the detonating cord through the inner end of the end fitting and a detonator from the outer end such that the detonator is adjacent to the detonating cord on the horizontal axis of the gun body. It may include overlapping the detonating cord and the detonator to form a side by side explosive coupling. It may include installing the pressure bulkhead into the baffle of the pin end of the gun carrier. It may include coupling the pressure bulkhead into a pin-by-pin tandem sub, wherein the tandem sub is inserted into the first end of the gun carrier. It may include coupling the pressure bulkhead into the second end of the gun carrier. It may include arming the perforating gun by inserting a wireless electric detonator, connector end facing up, into the end fitting detonator orifice. It may include attaching the selective switch to the pre-wired loading tube and wiring the detonator connector receptacle pass through to the upper end fitting. It may include connecting the insulated wire to the switch within the lower end fitting, in which the detonator connector receptacle wire runs the length of the loading tube and the receptacle end passes through the upper end fitting.

BRIEF DESCRIPTION OF THE DRAWINGS

For a thorough understanding of the present invention, reference is made to the following detailed description of the preferred embodiments, taken in conjunction with the accompanying drawings in which reference numbers designate like or similar elements throughout the several figures of the drawing. Briefly.

DETAILED DESCRIPTION OF EXAMPLES OF THE INVENTION

In the following description, certain terms have been used for brevity, clarity, and examples. No unnecessary limitations are to be implied therefrom and such terms are used for descriptive purposes only and are intended to be broadly construed. The different apparatus, systems and method steps described herein may be used alone or in combination with other apparatus, systems and method steps. It is to be expected that various equivalents, alternatives, and modifications are possible within the scope of the appended claims.

Terms such as booster may include a small metal tube containing secondary high explosives that are crimped onto the end of detonating cord. The explosive component is designed to provide reliable detonation transfer between perforating guns or other explosive devices, and often serves as an auxiliary explosive charge to ensure detonation.

Detonating cord is a cord containing high-explosive material sheathed in a flexible outer case, which is used to connect the detonator to the main high explosive, such as a shaped charge. This provides an extremely rapid initiation sequence that can be used to fire several shaped charges simultaneously.

A detonator or initiation device may include a device containing primary high-explosive material that is used to initiate an explosive sequence, including one or more shaped charges. Two common types may include electrical detonators and percussion detonators. Detonators may be referred to as initiators. Electrical detonators have a fuse material that burns when high voltage is applied to initiate the primary high explosive. Percussion detonators contain abrasive grit and primary high explosive in a sealed container that is activated by a firing pin. The impact of the firing pin is sufficient to initiate the ballistic sequence that is then transmitted to the detonating cord.

An example embodiment may comprise a modular perforating gun system in which the selective switch is embodied in the end fitting of the loading tube assembly of the perforating gun. The top or bottom end fitting is designed to hold a selective switch, a feed through contact and orifices to insert the detonator from one end and the detonating cord from the other. The opposite end fitting is designed to connect to a pressure bulkhead containing the feed through contact. Ground is made through charge tube to the end fitting to bulkhead to baffle to gun body. The loading tube is prewired and terminated to the pressure bulkhead feed through contact at one end and the selective switch at the other end. The gun carrier is box by pin with bottom of gun carrier having a swaged and threaded end. Alternatively, may have a thin shoulder pin-pin tandem sub.

Figure 1:
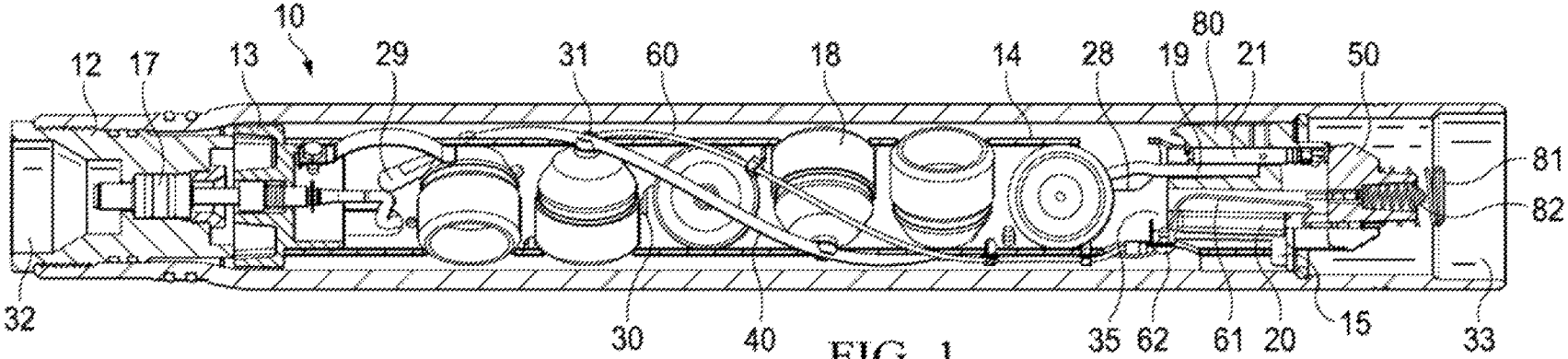
FIG. 1 shows an example embodiment of a modular gun system cross section.
Figure 2:
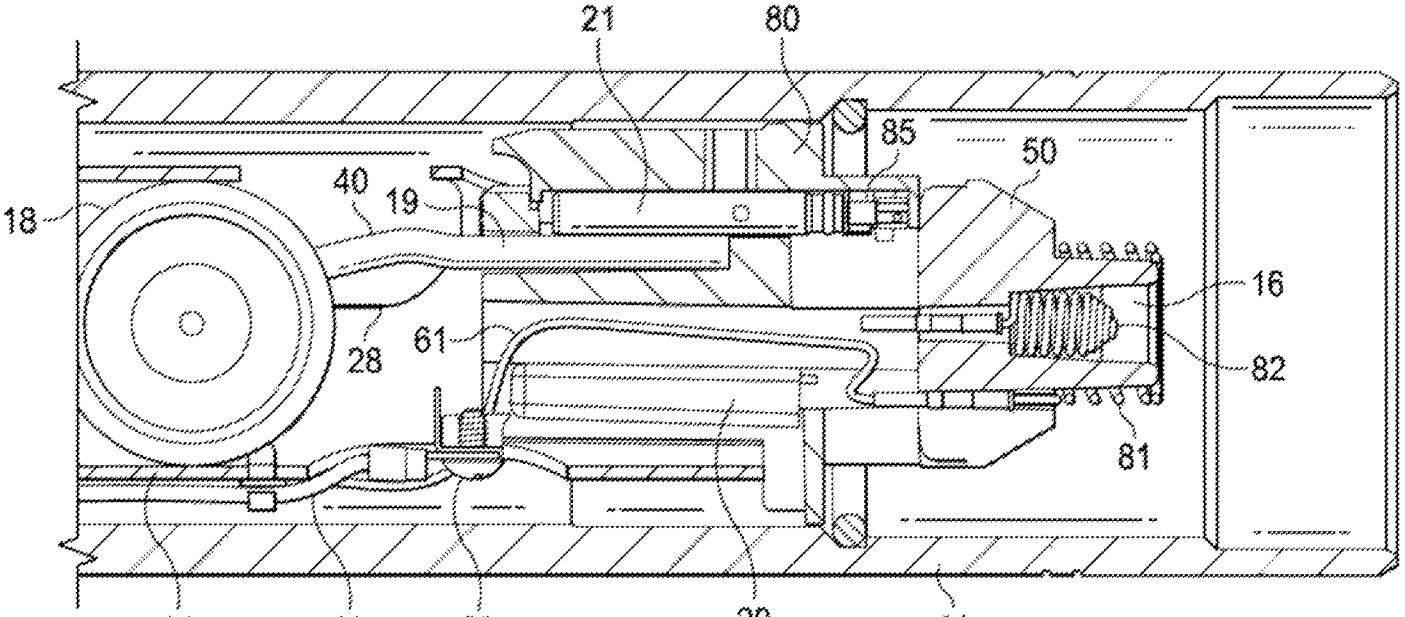
FIG. 2 shows a close up of an example embodiment of the end of a modular gun system cross section.
Figure 3:
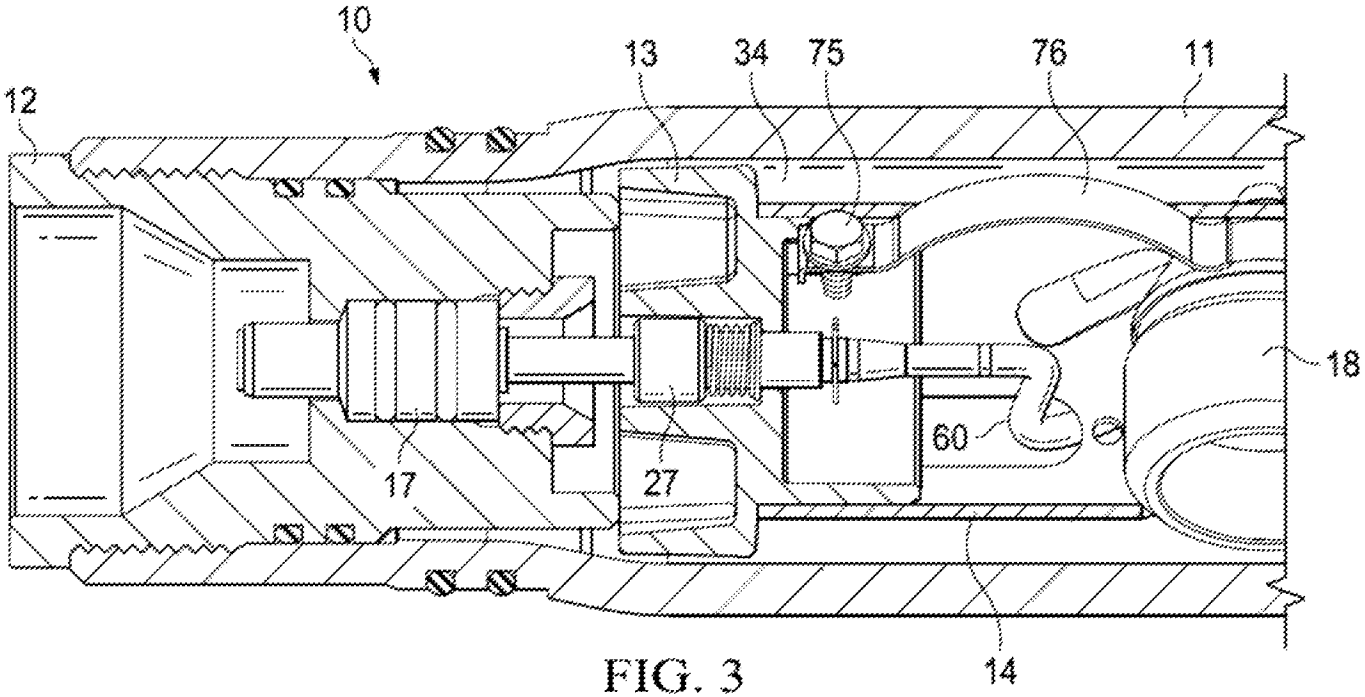
FIG. 3 shows an example embodiment of an end of a modular gun system cross section.

An example embodiment is shown in FIGS. 1-3. The example embodiment includes a perforating gun assembly 10 having a cylindrical body housing 11, in the charge tube 14, with a lower end 32 and an upper end 33. A baffle 12 with a pressure bulkhead bottom contact 17 disposed therein is further coupled to the lower end 32 of the cylindrical body housing 11.

A charge tube 14 is loaded with shaped charges 18 and disposed within, and coupled to, the cylindrical body housing 11. In this example embodiment, the charge tube 14 may be pre-wired. The baffle 12 is adjacent to the lower end fitting 13 which is coupled to the lower end 34 of the charge tube 14. A charge tube is also known as a loading tube. The charge tube 14 has loading tube cutouts 29 located proximate to the lower end 34 and loading tube cutouts 28 located proximate to the upper end 35. The charge tube 14 has a lower end fitting 13 located proximate to the lower end 34 and a upper end fitting 50 located proximate to the upper end 35. A locking means for shaped charges 18 may include the tabs 30 located on shaped charges 18. A detonator cord locking means may include the retainer fitting 31 located on the end of the shaped charges 18. The selective switch 20 is grounded to the cylindrical body via ground wire 61 coupled to grounding screw 62. Signal wire 60 is used to send signals through perforating gun 10 and is pre-wired into the charge tube 14. Signal wire 60 is insulated from the cylindrical body 11, which is conductive and acts as a ground. A detonating cord 40 is coupled to each of the shaped charges 18. A ground wire 61 from the selective switch 20 is coupled to the charge tube 14 via fastener 62. The upper end fitting 50 includes a door 80 that is adapted to receive the detonator 21. Door 80 is hinged, it opens outward, and it snaps into a closed position in a recess, aligning the detonator in a side-by-side configuration with the end of the detonating cord, in the end fitting 50. The signal is conducted through the upper end fitting 50 via feed thru spring 82 and the ground is conducted through the upper end fitting 50 via ground spring 81.

The upper end fitting 50 includes a selective switch 20, a wireless detonator 21, a detonating cord orifice 19, and a top contact 16 in FIG. 2. A closer view of upper end fitting 50 is shown in FIG. 2. The ground lug 62 and ground wire 61 allows the selective switch 20 to be grounded to the charge tube 14. The selective switch 20 is connected to the wireless detonator 21 via the modular connector assembly 85. The modular connector assembly 85 has an auto-shunting feature whereby the wireless detonator 21 is shunted until the correct connector is inserted. A detonating cord 40 wraps around the outside of the charge tube 14, connecting to each of the shaped charges 18 via connectors 31, and terminates within the charge tube 14, through the loading tube cutout 28, and into the detonating cord orifice 19, which is located proximate to the wireless detonator 21. The detonating cord 40 may be located in an end-to-end or side-by-side configuration with the wireless detonator 21. The modular connector assembly 85 may include the example embodiments in FIGS. 12A-18, as disclosed herein.

The lower end 34 of the perforating gun assembly 10 is shown in FIG. 3 including a baffle 12 coupled to the lower end 34 and located proximate to the lower end fitting 13. The pressure bulkhead bottom contact 17 is coupled to an insulated wire 27. The loading tube 14 includes shaped charges 18 having locking tabs 30 for locking into the loading tube 14. The shaped charges 18 have detonating cord locking clips 31 that couple to a detonating cord 40 wrapped along the outside of the loading tube 14. Ground contact with the charge tube 14 is maintained by spring connection 76 coupled to the lower end fitting 13 via fastener 75.

Figure 4:
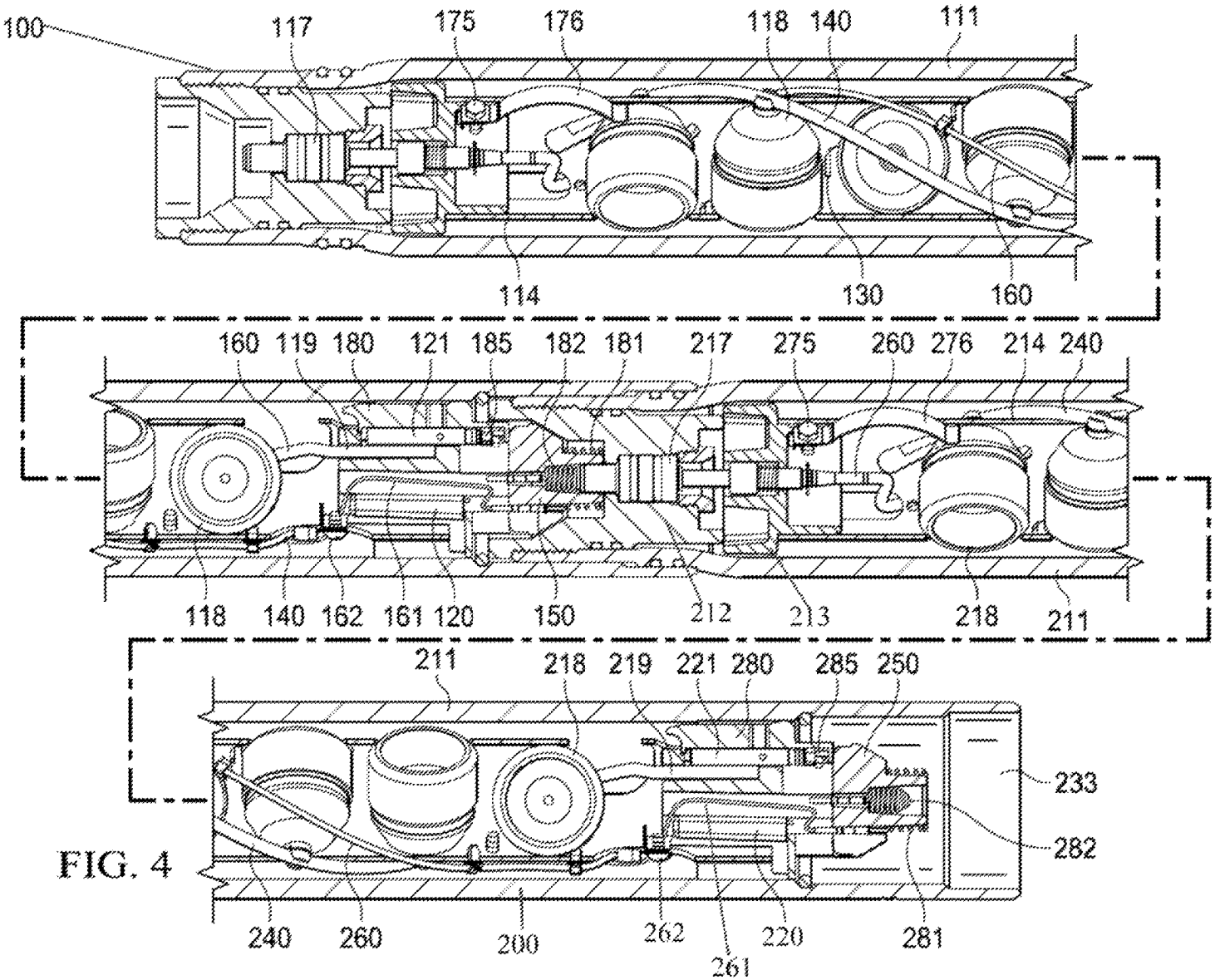
FIG. 4 shows an example embodiment of two modular perforating guns coupled together.

Two perforating guns, a lower gun 100 and an upper gun 200 are shown in FIG. 4 depicting a close up of the gun-to-gun connection. The two perforating guns 100 and 200 are configured similarly and this example embodiment shows how the guns are coupled together. The perforating gun 100 has a charge tube 114 located within a cylindrical body 111. The charge tube 114 contains shaped charges 118 coupled to detonating cord 140 and an upper end fitting 150. Upper end fitting 150 contains a selective switch 120 coupled to a wireless detonator 121, which is further located adjacent to a detonating cord end 119. Detonating cord end 119 may include a booster. Pressure Bulkhead bottom contact 217 is disposed within and coupled to bottom end fitting 212. Perforating gun 200 also contains a charge tube 214 located within a cylindrical body 211 and containing perforating charges 250 coupled to detonating cord 240. Perforating gun 200 also has an upper fitting 250 that contains a selective switch 220 coupled to a wireless detonator 221 via modular connector assembly 285, which is further located adjacent to a detonating cord end 219. Detonating cord end 219 may have a booster. Signal wire 160 is used to send signals through perforating gun 100 and is pre-wired into charge tube. Signal wire 160 is insulated from the cylindrical body 111, which is conductive and acts as a ground. The selective switch 120 is grounded to the cylindrical body via ground wire 161 coupled to grounding screw 162. Signal wire 260 is used to send signals through perforating gun 200 and is pre-wired into charge tube. Signal wire 260 is insulated from the cylindrical body 211, which is conductive and acts as a ground. The selective switch 220 is grounded to the cylindrical body via ground wire 261 coupled to grounding screw 262. Bulkhead contact 117 provides the signal continuity to signal wire 160. Ground spring strap 176 coupled to the end fitting via fastener 175 grounds the charge tube 114. Upper end fitting 150 contains an outward opening door 180 that is coupled via modular connector assembly 185 to detonator 121. Door 180 is hinged, it opens outward, and it snaps into a closed position in a recess, aligning the detonator in a side-by-side configuration with the end of the detonating cord, in the end fitting 150. Feed thru spring 182 provides signal continuity through the upper end fitting 150. Ground spring 181 provides ground continuity between the upper end fitting 150 and the bottom end fitting 212. Ground spring strap 276 coupled to the end fitting 213 via fastener 275 further grounds the charge tube 214. Charge tube 214 contains shaped charges 218. The modular connector assembly 185 and 285 may include the example embodiments in FIGS. 12A-18, as disclosed herein.

Figure 5:
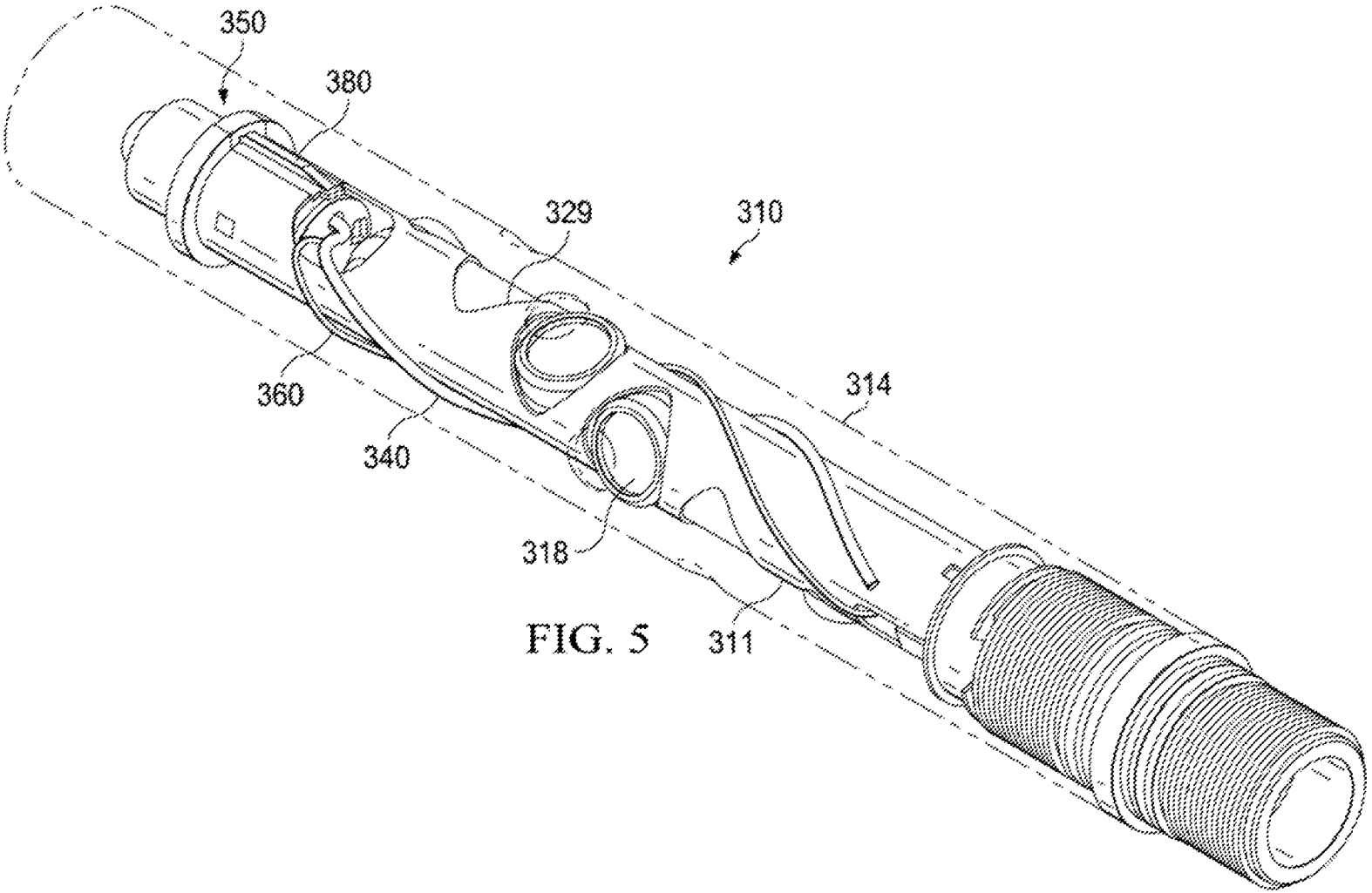
FIG. 5 shows an example embodiment of perforating gun assembly.

An example embodiment is disclosed in FIG. 5 of a perforating gun assembly 310. It includes a gun body 314 containing a charge tube 311. The first end of the charge tube 311 is coupled to the first end of the gun body 314 via lower end fitting. The second end of the charge tube 311 is coupled to the second end of the gun body 314 via upper end fitting 350. Upper end fitting 350 includes an integrated switch and contains a detonator underneath detonator door 380. Door 380 is hinged, it opens outward, and it snaps into a closed position in a recess, aligning the detonator in a side-by-side configuration with the end of the detonating cord, in the end fitting 350. The charge tube includes cutouts 329 for the shaped charges 318. A signal wire 360 carries an electrical signal to the switch located in the upper end fitting 350. The shaped charges 318 are contained in the charge tube 311. The shaped charges 318 are coupled to the detonating cord 340. Electrical wire 360 transmits signals to the integrated switch located into the upper end fitting 350.

Figure 6:
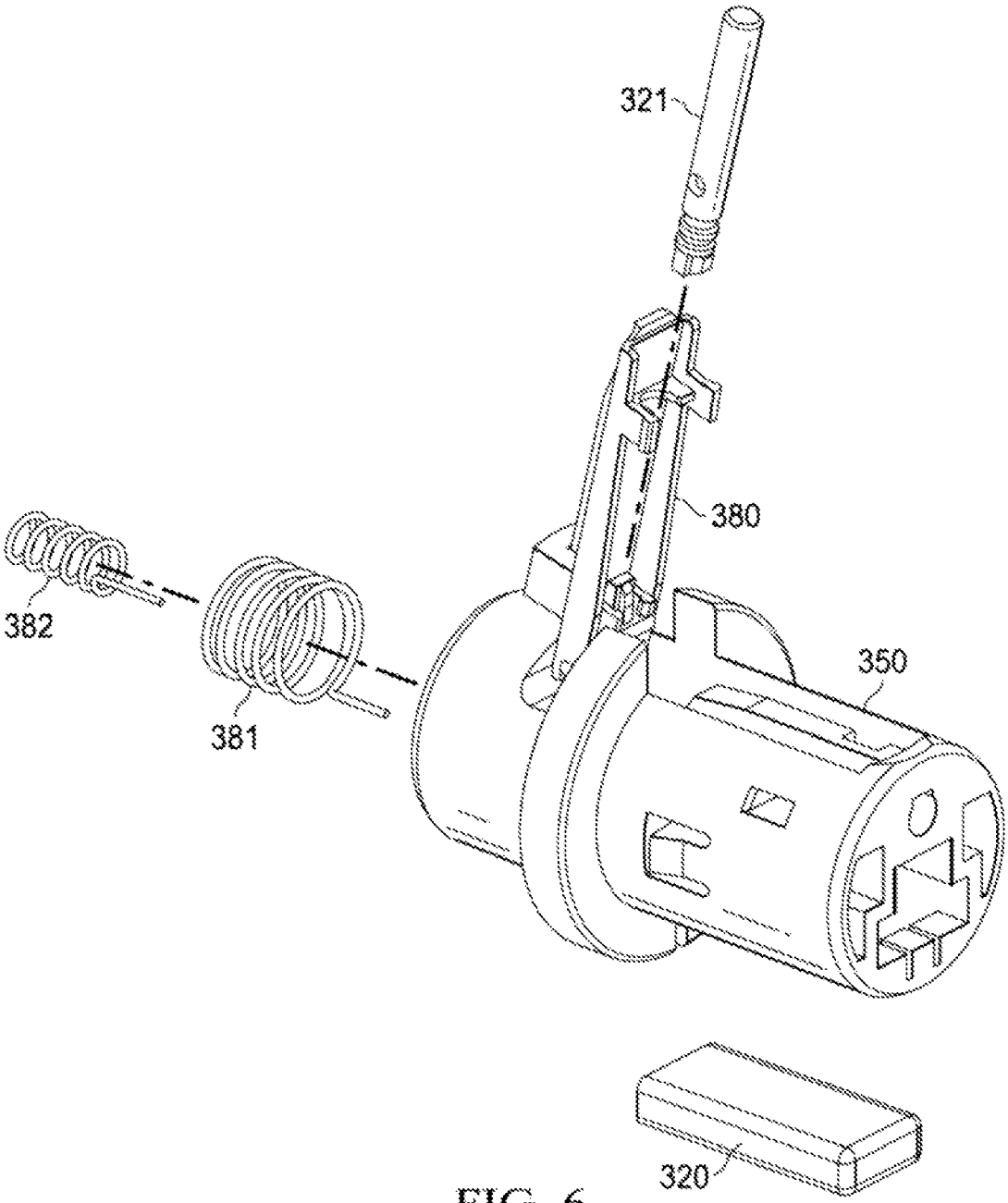
FIG. 6 shows an example embodiment of an end fitting with a door to receive an initiator.

An example embodiment is disclosed in FIG. 6 of the upper end fitting 350. Upper end fitting 350 includes an integrate switch 320 and a detonator 321 contained underneath detonator door 380. It also includes a ground spring 381 for maintaining a ground connection through the upper end fitting 350. It also includes a feed thru spring 382 for conveying electrical signals through the upper end fitting 350. Ground spring 381 conveys the ground through the upper end fitting.

Figure 7:
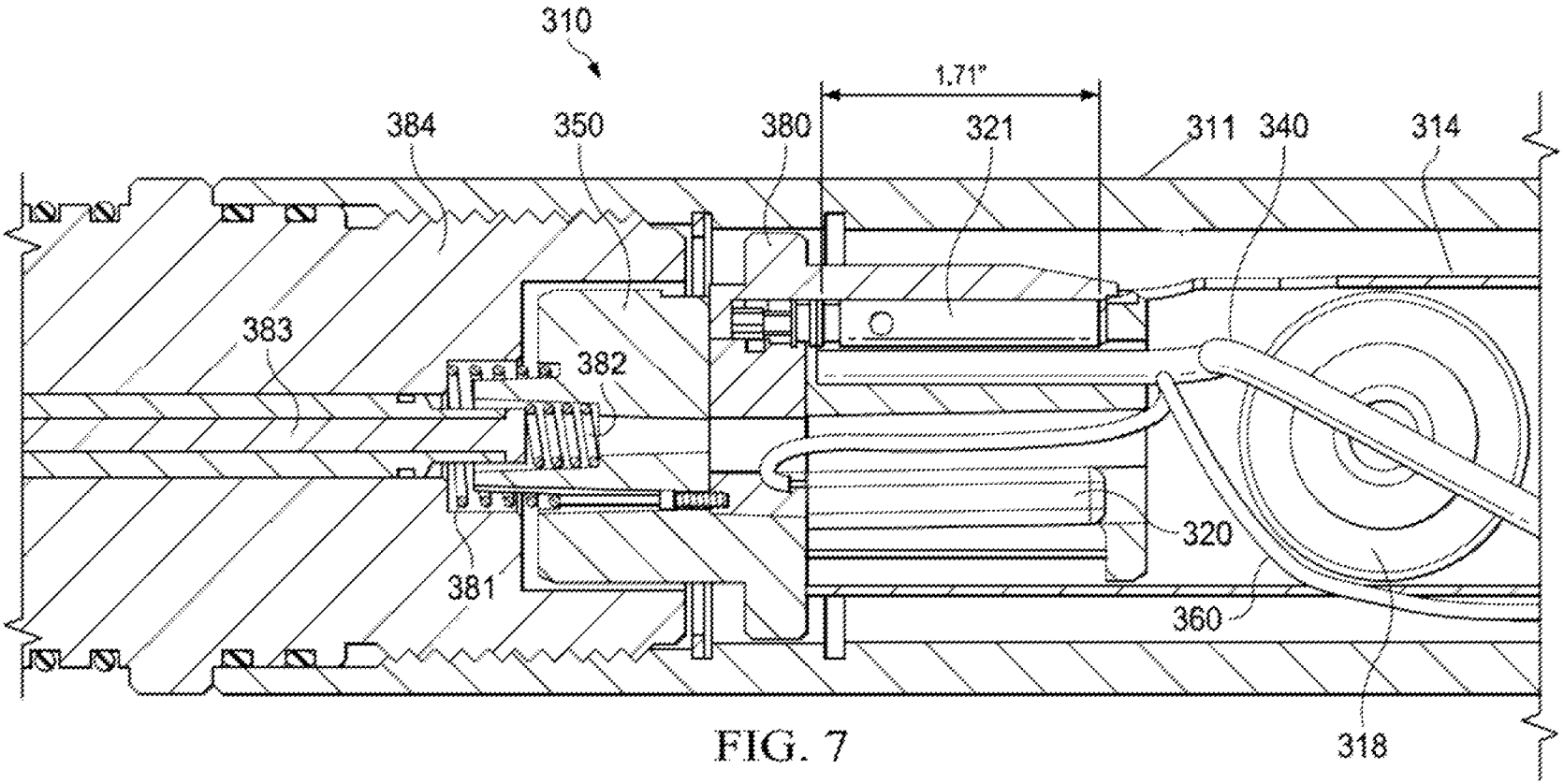
FIG. 7 shows a side cross section view of an example embodiment of an end fitting with a door to receive an initiator.

An example embodiment is disclosed in FIG. 7 of the upper end fitting 350 installed within a perforating gun assembly 310. Housing 311 contains an upper end fitting 350 includes an integrated switch 320 and a detonator 321 contained underneath detonator door 380. It also includes a ground spring 381 for maintaining a ground connection through the upper end fitting 350. It also includes a feed thru spring 382 for conveying electrical signals between the electrical pin 383, the integrated switch 320, and the signal wire 360. Sub 384 contains electrical pin 383 that contacts with feed thru spring 382. Detonating cord 340 is coupled to the shaped charges 318 located in the charge tube 314.

Figure 8A:
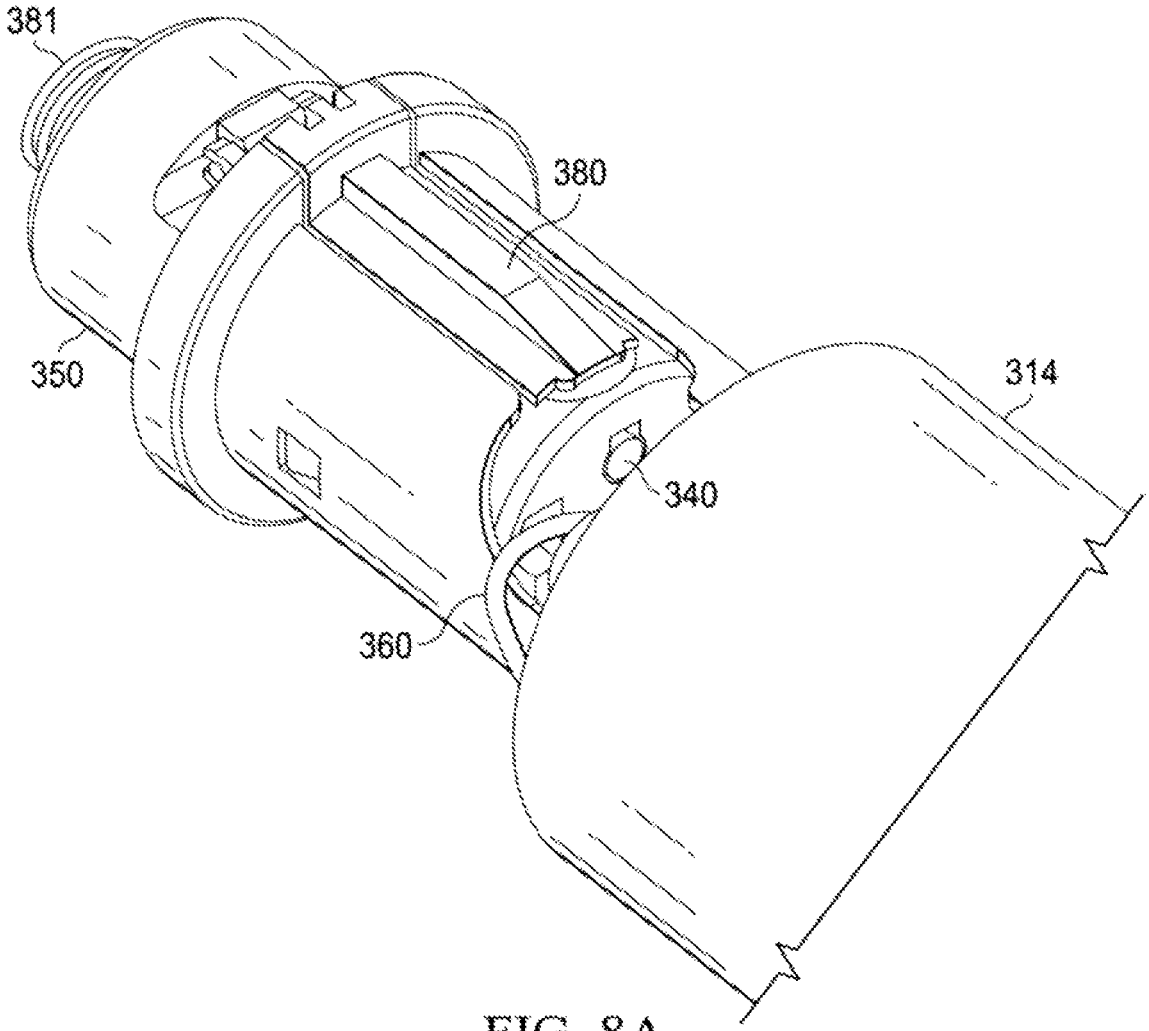
FIG. 8A shows an example embodiment of an end fitting with a door to receive an initiator.
Figure 8B:
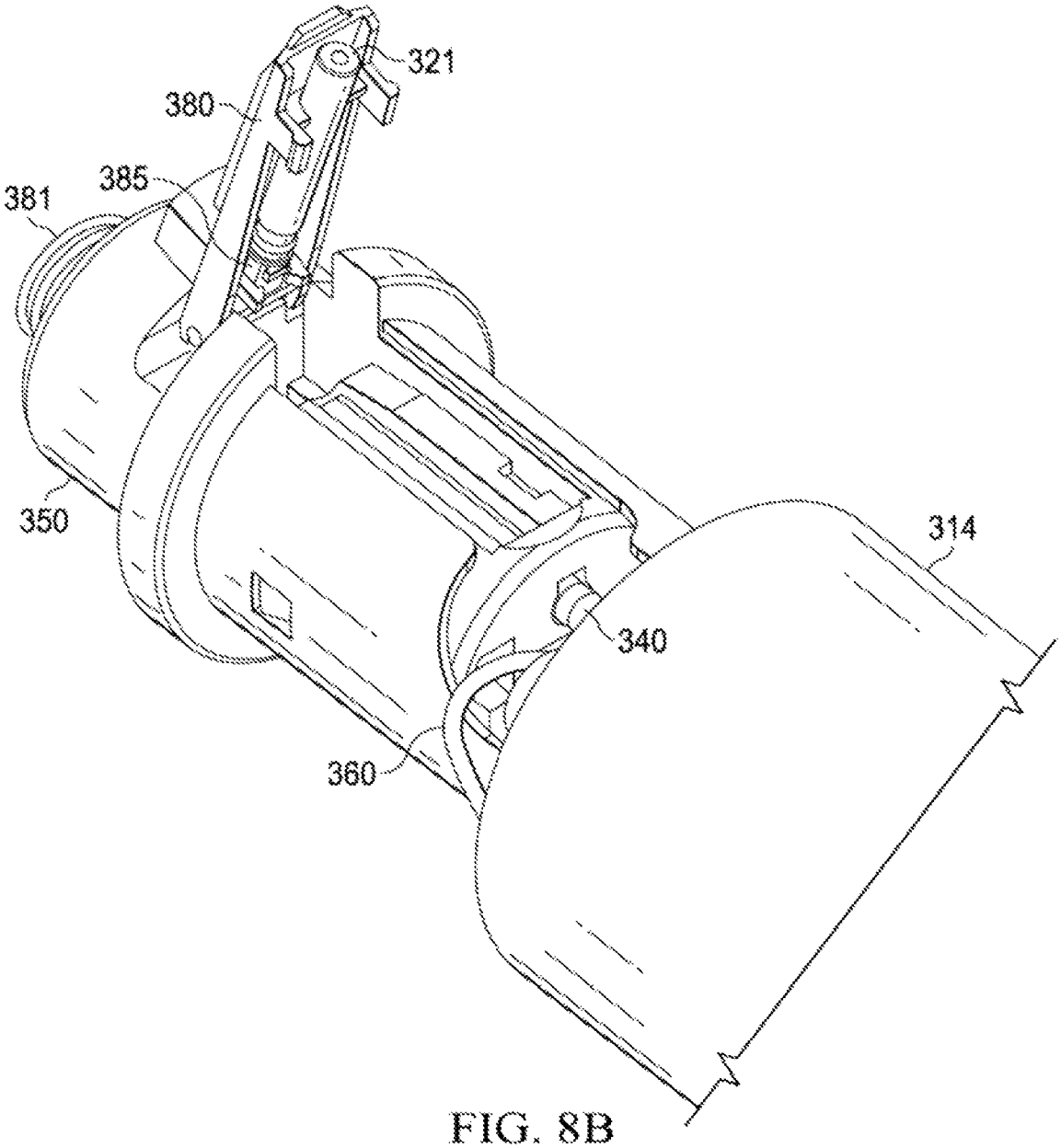
FIG. 8B shows an example embodiment of an end fitting with a door to receive an initiator.

An example embodiment is disclosed in FIGS. 8A and 8B of the upper end fitting 350 partially outside of the gun body 314. Upper end fitting 350 includes an integrated switch 320 and a detonator 321 contained underneath detonator door 380. It also includes a ground spring 381 for maintaining a ground connection through the upper end fitting 350. It also includes a feed thru spring 382 for conveying electrical signals through the upper end fitting 350. Detonating cord 340 is detonated by the detonator 321 located in detonator door 380. Signal wire 360 sends the initiation signal to the initiator 321. The detonator 321 is received by modular connector assembly 385 which may include an auto-shunting feature. The modular connector assembly 385 may include the example embodiments in FIGS. 12A-18, as disclosed herein.

Figure 9A:
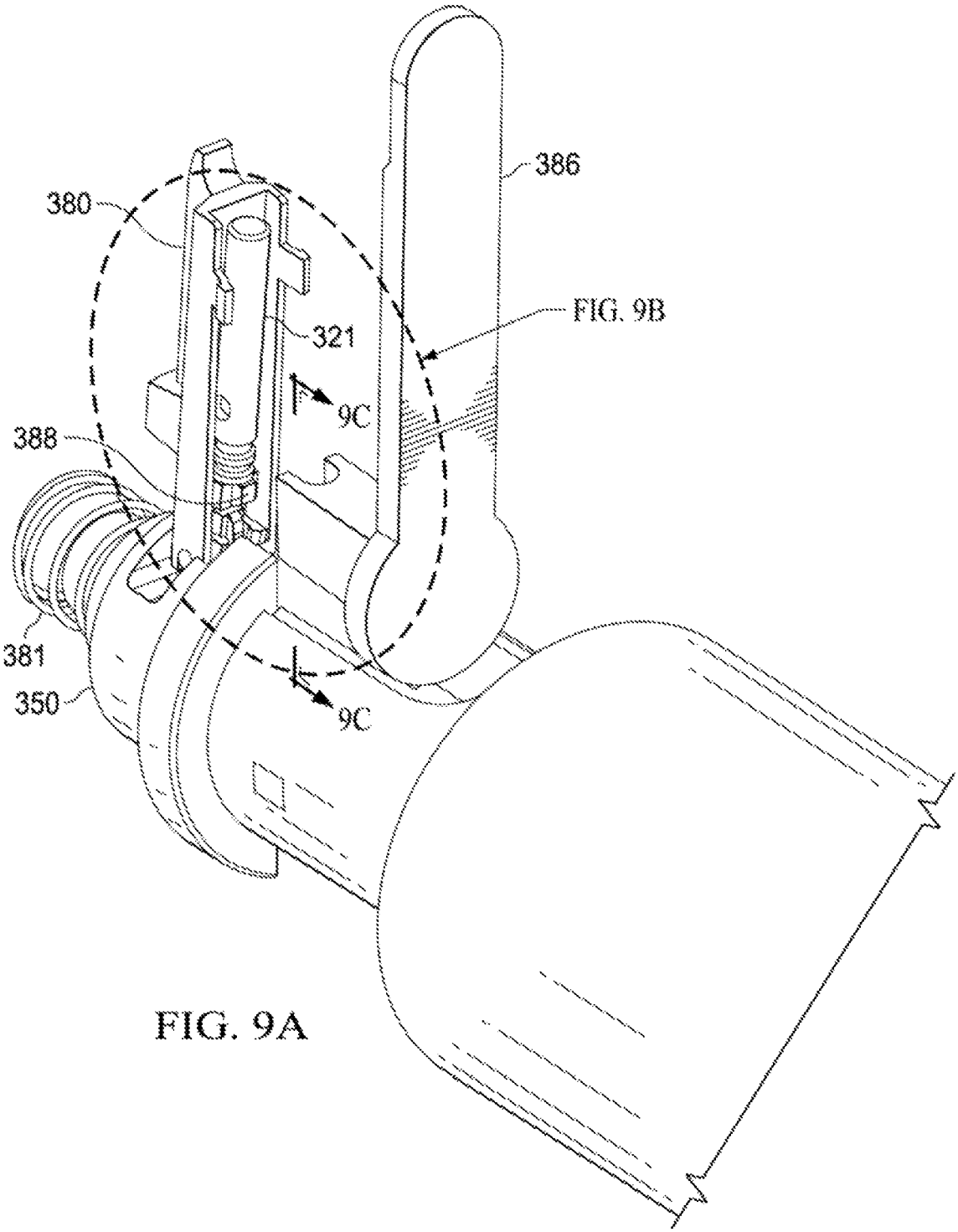
FIG. 9A shows an example embodiment of an end fitting with a door to receive an initiator.
Figure 9B:
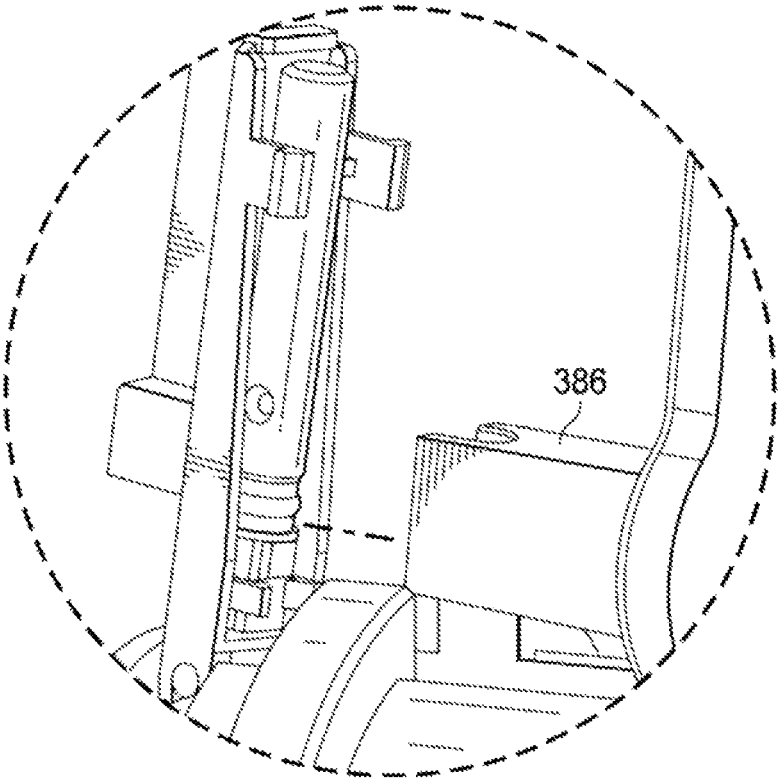
FIG. 9B shows an example embodiment of an end fitting with a door to receive an initiator.
Figure 9C:
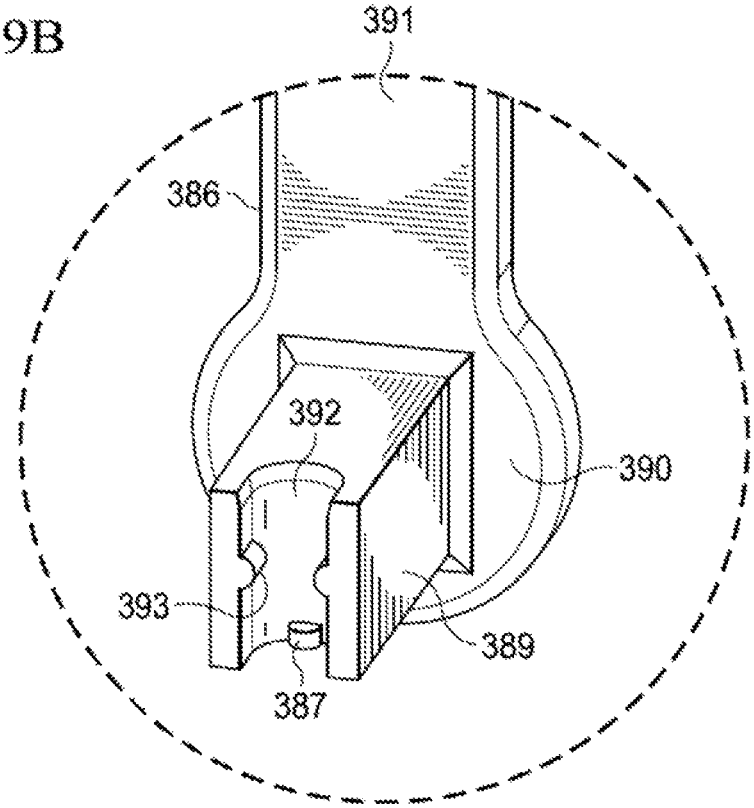
FIG. 9C shows an example embodiment of an end fitting with a door to receive an initiator.

An example embodiment is disclosed in FIGS. 9A, 9B, and 9C of the upper end fitting 350. Upper end fitting 350 includes an integrated switch 320 and a detonator 321 contained underneath detonator door 380. It also includes a ground spring 381 for maintaining a ground connection through the upper end fitting 350. It also includes a feed thru spring 382 for conveying electrical signals through the upper end fitting 350. The detonator install tool 386 is shown having a handle 391, a head 390, with an extension 389 having a radial opening 392 for holding a detonator 321. The pins 393 and tap 387 help hold the detonator 321 in place when installing or removing. Tap 387 engages tab 388 to positively engage with the detonator 321. The detonator 321 is plugged into connector 381.

Figure 10:
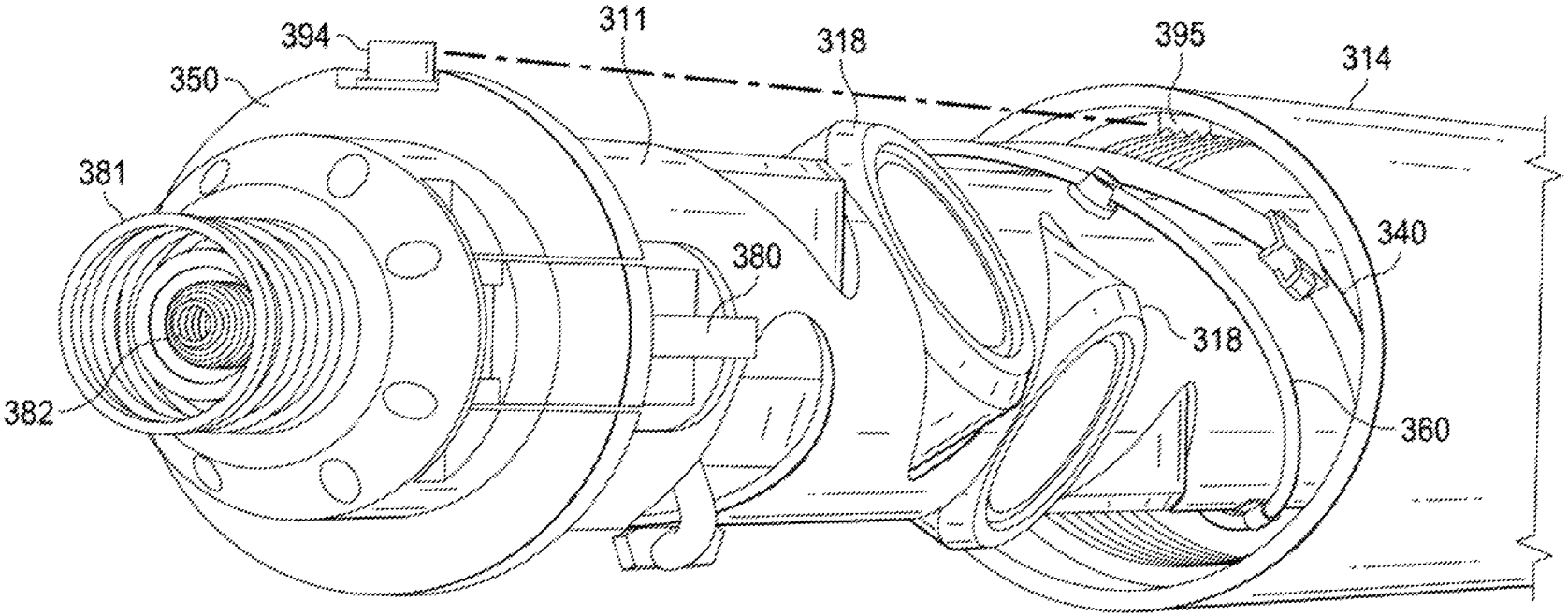
FIG. 10 shows an example embodiment of an end fitting in a perforating gun assembly.

An example embodiment is disclosed in FIG. 10 of the upper end fitting 350. Upper end fitting 350 includes an integrated switch 320 and a detonator 321 contained underneath detonator door 380. It also includes a ground spring 381 for maintaining a ground connection through the upper end fitting 350. It also includes a feed thru spring 382 for conveying electrical signals through the upper end fitting 350. In this view the shaped charges 318 are secured by locking tabs into the charge tube 311. Charge tube 311 containing shaped charges 318 is slideably engaged with the gun housing 314. Signal wire 360 and detonating cord 340 are wrapped around the charge tube 311. The gun housing 314 has internal threads having a thread cutout 395 for allowing the nut 394 on the upper end fitting 350 to slide past the threads.

Figure 11B:
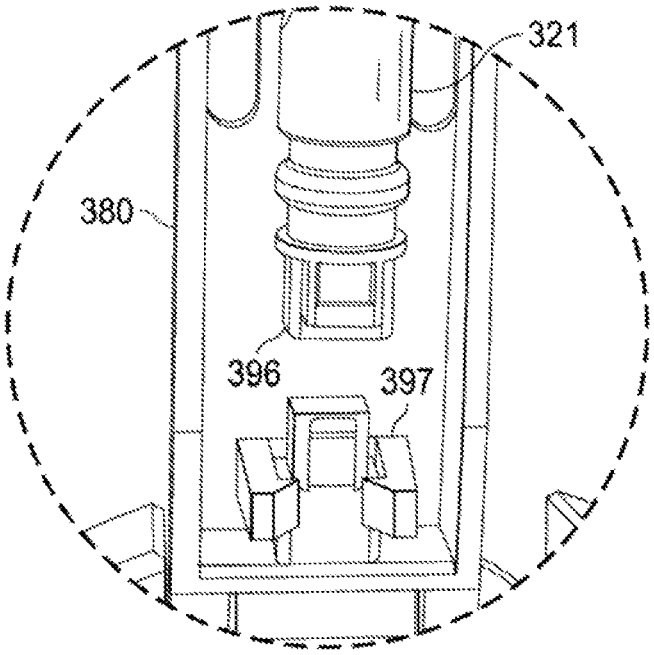
FIG. 11B shows an example embodiment of an end fitting with a door to receive an initiator.
Figure 11A:
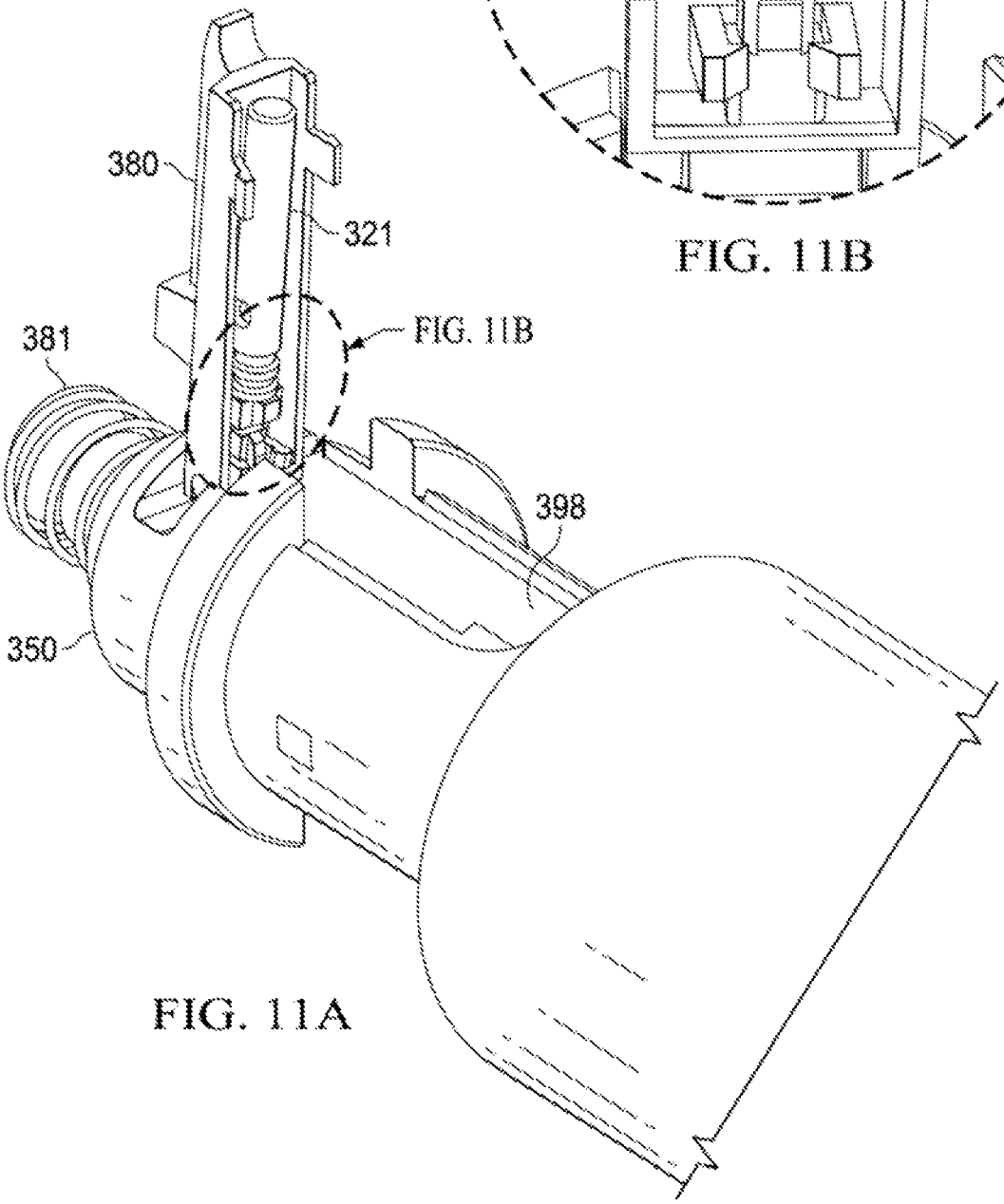
FIG. 11A shows an example embodiment of an end fitting with a door to receive an initiator.

An example embodiment is disclosed in FIGS. 11A and 11B of the upper end fitting 350. Upper end fitting 350 includes an integrated switch 320 and a detonator 321 contained underneath detonator door 380 that closes into recess 398. It also includes a ground spring 381 for maintaining a ground connection through the upper end fitting 350. It also includes a feed thru spring 382 for conveying electrical signals through the upper end fitting 350. The detonator 321 is plugged into connection 381 having a header connector 396 and a receptacle connector 397.

Figure 12B:
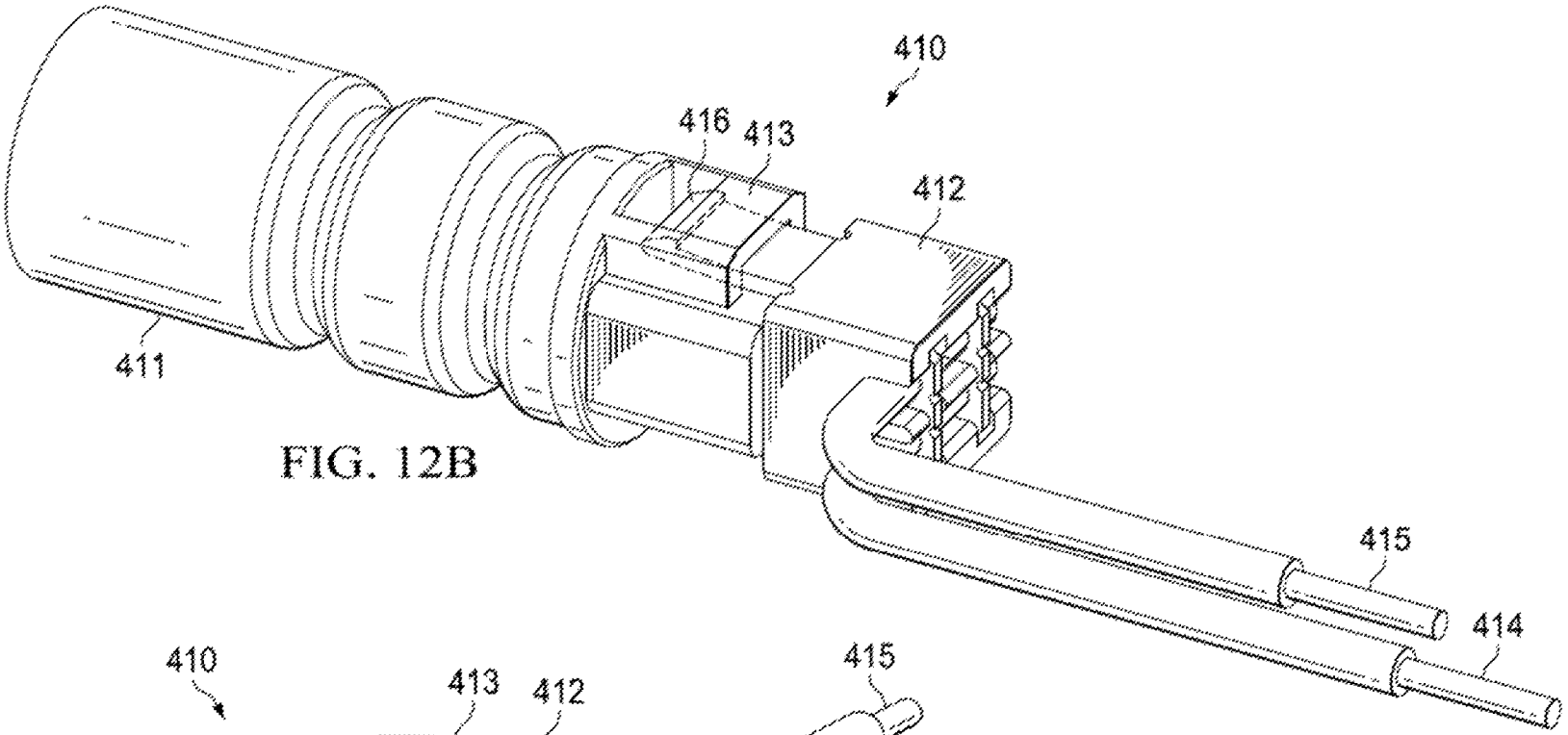
FIG. 12B shows a modular connector assembly.
Figure 12A:
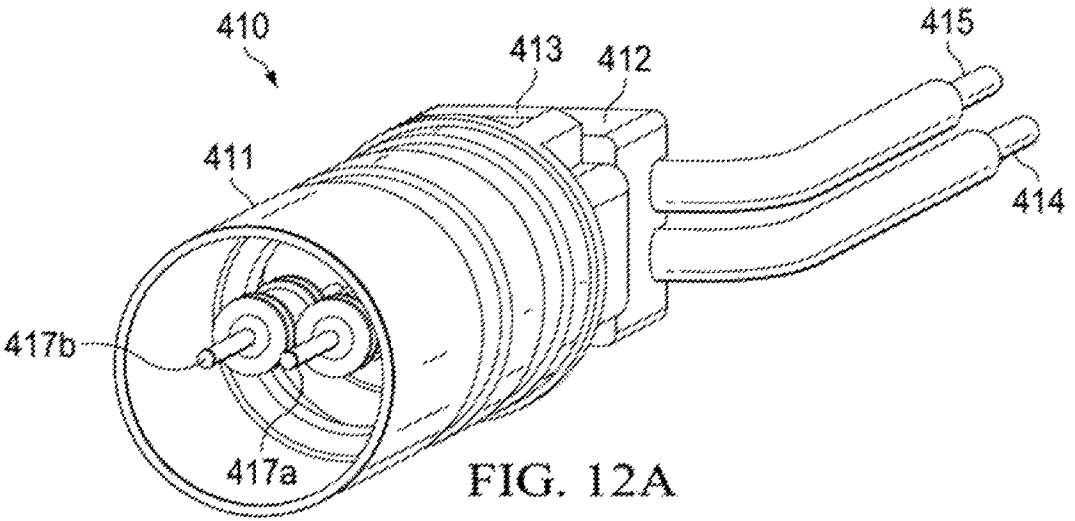
FIG. 12A shows a modular connector assembly.

A modular initiator is depicted in FIG. 12A and FIG. 12B. The modular initiator serves the purpose of providing a high energy output to initiate a second explosive device such as a detonating cord, a booster, a power charge, or propellant. The modular initiator requires electrical input to transfer electrical energy into a high energy output. The modular initiator contains a rigid connector for the purpose of assembling the initiator to a receiving circuit or installing in a contact block such that it may function as a standalone unit. The modular initiator may be used in a variety of explosive systems requiring electrical initiation.

A contact block provides electrical feed through to allow the modular initiator to function without the need for additional electrical connections. The electrical circuit may be a printed circuit board, flexible circuit board, or other commonly used electrical boards or combinations. There may be many features included in the circuitry including switches, safety features, RF isolation, two-way communication with the surface, temperature measurement circuitry, pressure measurement circuitry, and other features not directly required for initiating the modular initiator. Electrical energy will pass through the electrical circuit to initiate the modular initiator through a rigid connector.

Figure 12C:
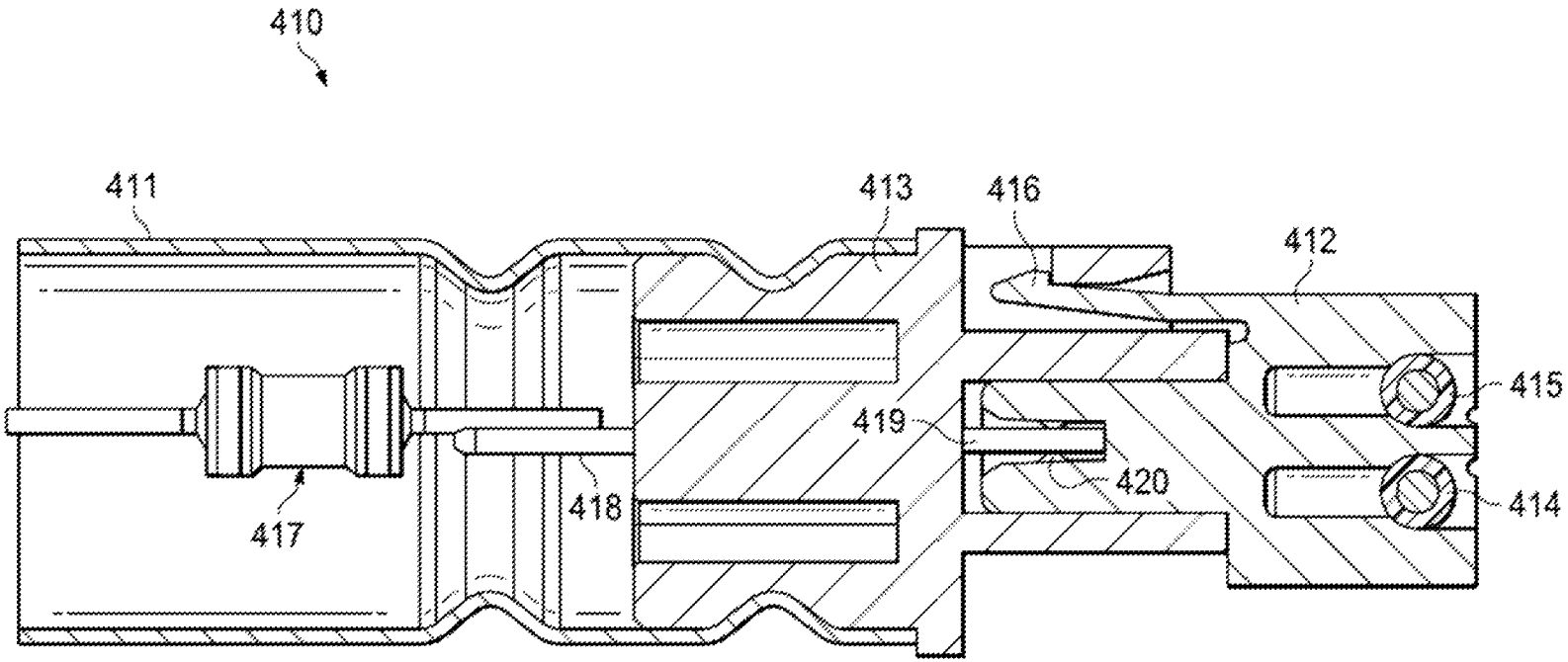
FIG. 12C shows a cross section of a modular connector assembly.

Referring to FIGS. 12A, 12B, and 12C, a modular connector assembly 410 has a receptacle 412 having a latch 416 and contacts 420 are coupled to the connector 413. Connector 413 includes contact blades 419 that engage with the contacts 420. The contact blades 419 are further coupled to the resistors 417*a* and 417*b* via resister leads 418. Resister leads 418, which may be continuous portions of contact blades 419, are coupled to corresponding resistors 417. A shell 411 is crimped onto the connector 413. Wire 414 and 415 are coupled to the receptacle 412. The design is such that each wire 414 or 415 has a corresponding contact 20, a corresponding contact blade 419, a corresponding resistor lead 418, and a corresponding resistor 417*a* or 417*b*. Latch 416 locks the receptacle 412 into the connector 413.

Figure 13A:
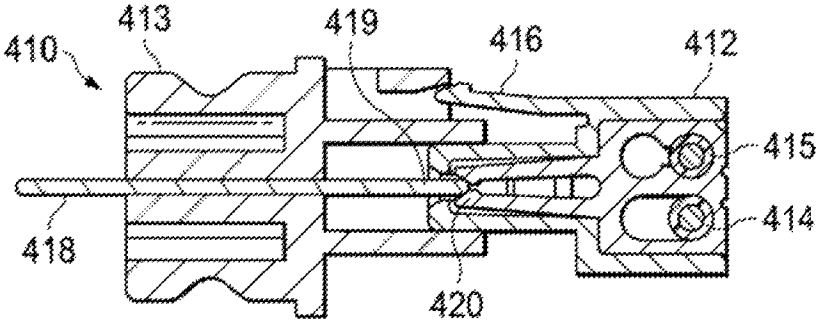
FIG. 13A shows a side cross section of a modular connector assembly.
Figure 13B:
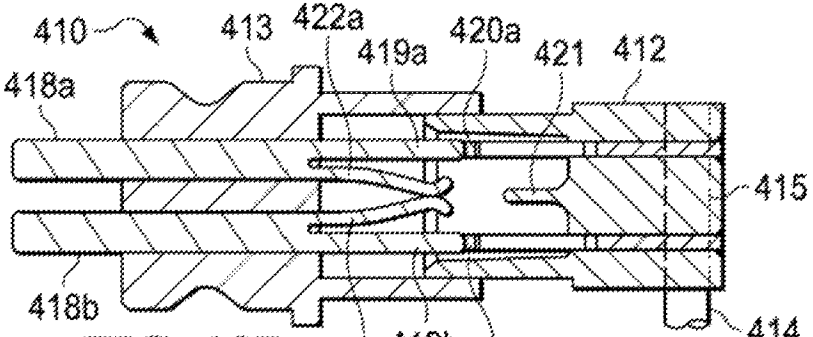
FIG. 13B shows a top cross section of a modular connector assembly.

Referring to FIGS. 13A, 13B, 13C, 13D, 13E, and 13F, a side cross section and corresponding side cross section of the modular connector assembly 410 are shown in different stages of engagement. Stage 1 is depicted by FIGS. 13A and 13B. In stage 1 the receptacle 412 is partially inserted into the connector 413, approximately one-third or less of the way inserted, there is no electrical connection between the receptacle 412 and connector 413 and the shunt, represented by shunt contacts 422*a* and 422*b*, are in the shunted position. In this configuration the modular connector assembly 410 is self-protected from radio frequency signals and stray voltages. As can be seen in FIG. 13B, the shunt contacts 422*a* and 422*b* are electrically in contact with each other, forming an electrical shunt between contact blades 419*a* and 419*b*. The latch 416 is not engaged. The signal contacts 420*a* and 420*b* are not engaged with the corresponding blades 419*a* and 419*b*. The separator 421, a non-conductive wedge shaped part of the receptacle 412, is not engaged with the shunt contacts 422*a* and 22*b*. Contact blades 419*a* and 419*b* have corresponding resistor contacts 418*a* and 418*b*. The wires 414 and 415 can be arranged side by side, or opposite of each other, depending on the application.

Figure 13C:
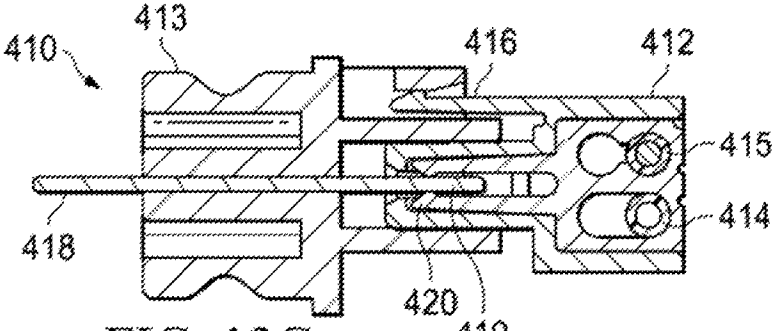
FIG. 13C shows a side cross section of a modular connector assembly.
Figure 13D:
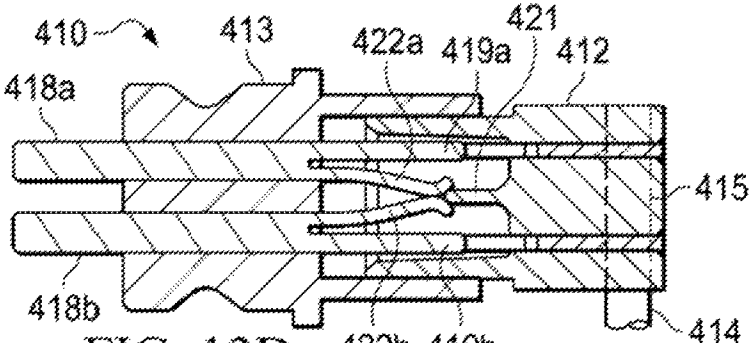
FIG. 13D shows a top cross section of a modular connector assembly.

Stage 2 is depicted in FIGS. 13C and 13D when the receptacle 412 is approximately between one third and two thirds of the way inserted into the connector 413. Here electrical connections have been established between the receptacle 412 and the connector 413 while the shunt remains in place due to shunt contacts 422*a* and 422*b* still being in contact. In this state the modular connector assembly 410 is electrically protected by the initiator shunt and the circuit connected to the receptacle and is in a transition state. As can be seen in FIG. 13D, the shunt contacts 422*a* and 422*b* are electrically in contact with each other, forming an electrical shunt between contact blades 419*a* and 419*b*. The latch 416 is deflected, but not engaged. The signal contacts 420*a* and 420*b* are engaged with the corresponding blades 419*a* and 419*b*. The separator 421, is beginning to make contact with the shunt contacts 422*a* and 422*b*, but it has not yet separated them.

Figure 13E:
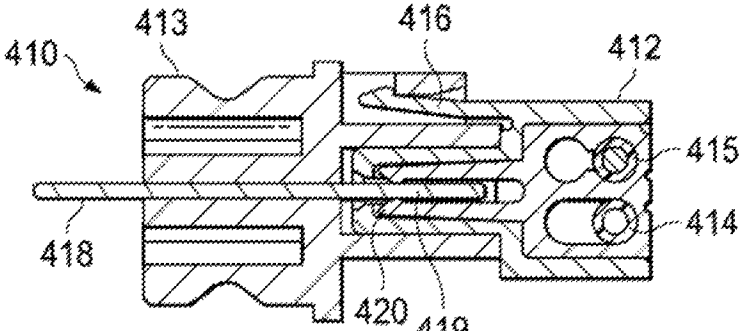
FIG. 13E shows a side cross section of a modular connector assembly.
Figure 13F:
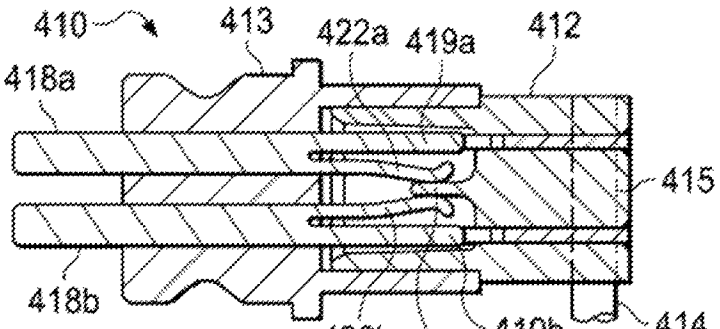
FIG. 13F shows a top cross section of a modular connector assembly.

Stage 3 is depicted in FIGS. 13E and 13F when the receptacle 412 is more than two thirds of the way inserted into connector 413. The receptacle 412 is in electrical communication with the connector 413 and is no longer shunted. As can be seen in FIG. 13F, the shunt contacts 422*a* and 422*b* are not electrically in contact with each other due to separator 421 wedging them apart, therefore contact blades 419*a* and 419*b* are unshunted. The latch 416 is engaged into the connector 413. The signal contacts 420*a* and 420*b* are engaged with the corresponding blades 419*a* and 419*b*.

Figure 14A:
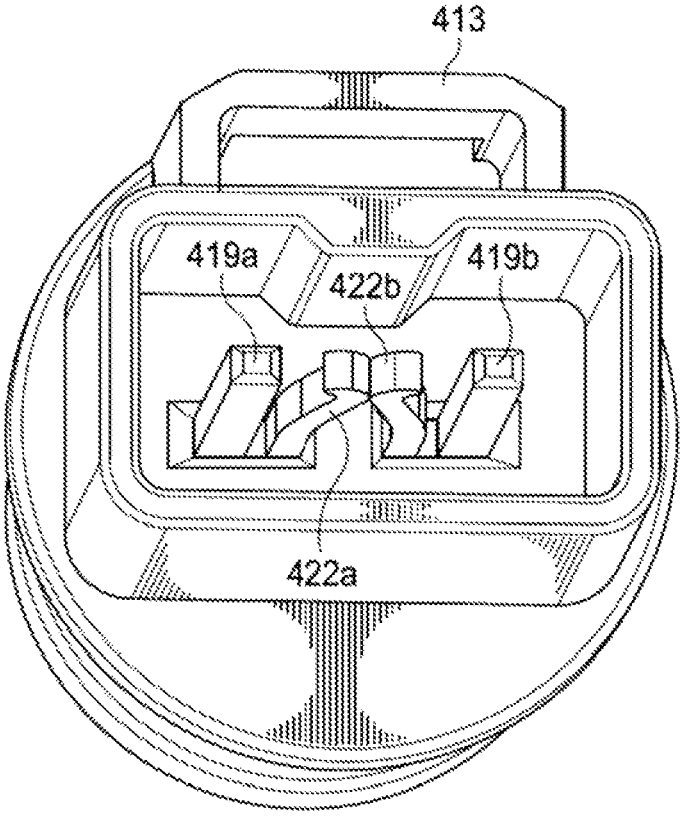
FIG. 14A shows a connector for a modular connector assembly.
Figure 14B:
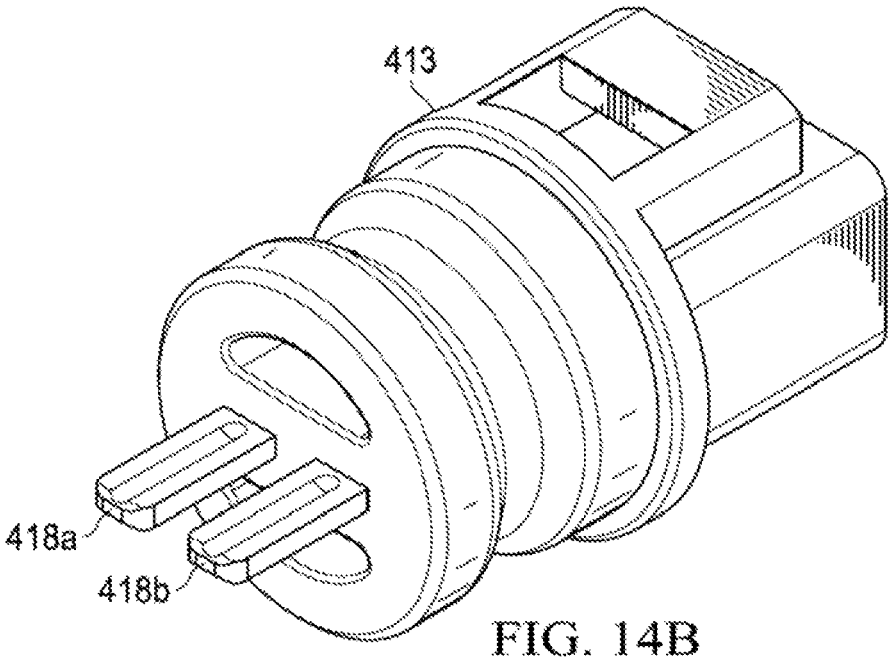
FIG. 14B shows a connector for a modular connector assembly.

FIGS. 14A and 14B show additional detail of the connector 413. The contact blades 419*a* and 419*b* and their corresponding shunt contacts 422*a* and 422*b* are shown. Furthermore, contact blades 149*a* and 419*b* have corresponding resistor contacts 418*a* and 418*b*.

Figure 15A:
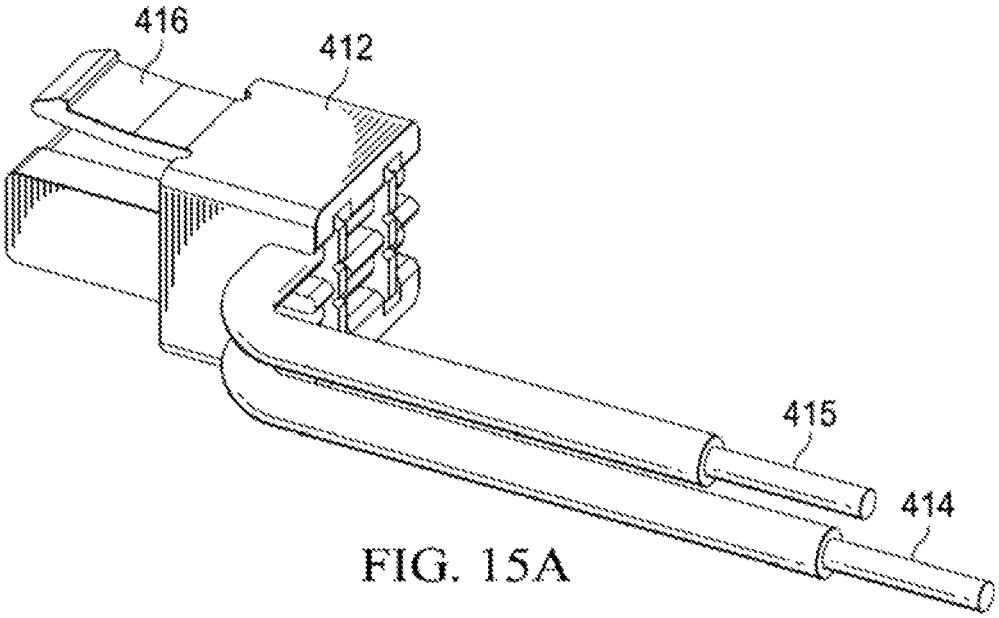
FIG. 15A shows a receptacle for a modular connector assembly.
Figure 15B:
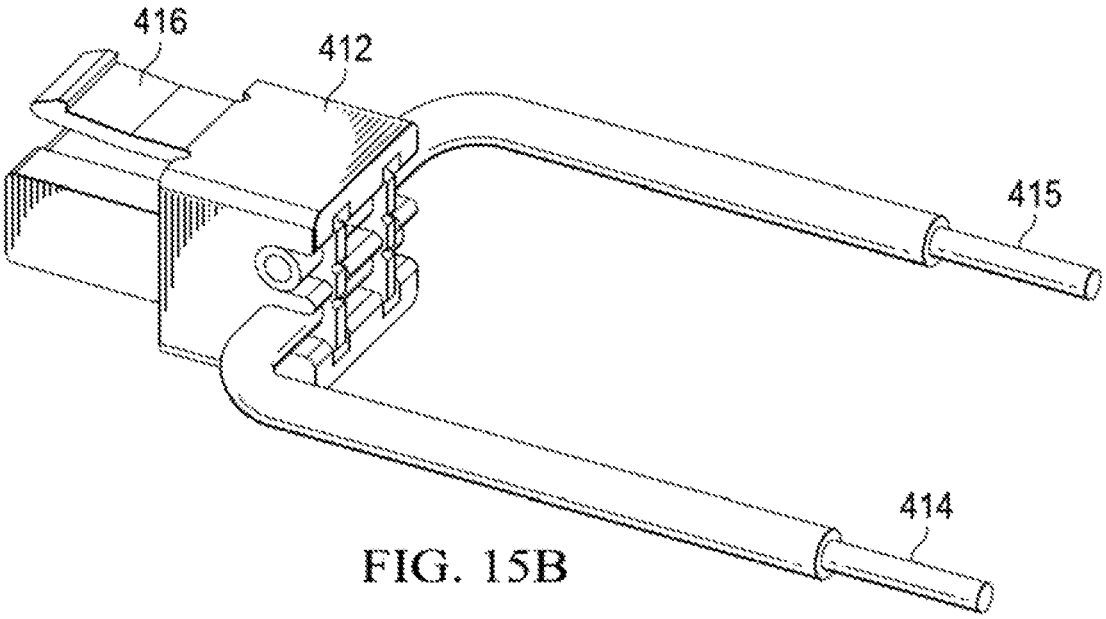
FIG. 15B shows a receptacle for a modular connector assembly.

FIGS. 15A and 15B show additional detail of the receptacle 412. The latch 416 is integrally formed to the receptacle. The wires 414 and 415 can be arranged side by side, or opposite of each other, depending on the application. In FIG. 15A one wire is strain-relieved while the other is not. In FIG. 15B both wires are strain relieved.

Figure 16A:
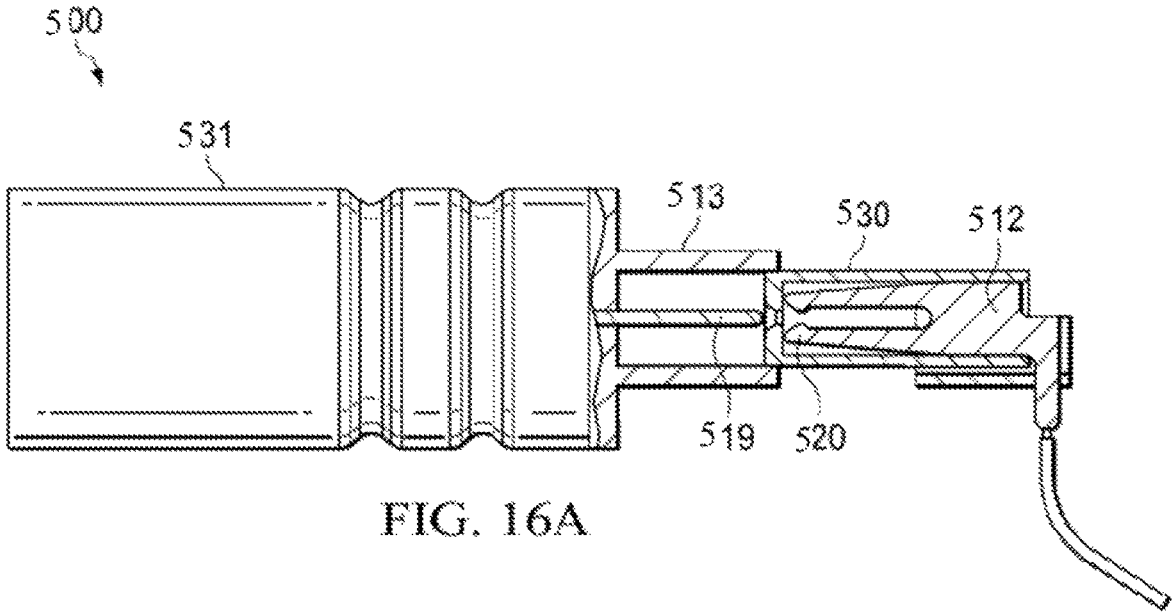
FIG. 16A shows a side cross section of a modular connector assembly.
Figure 16B:
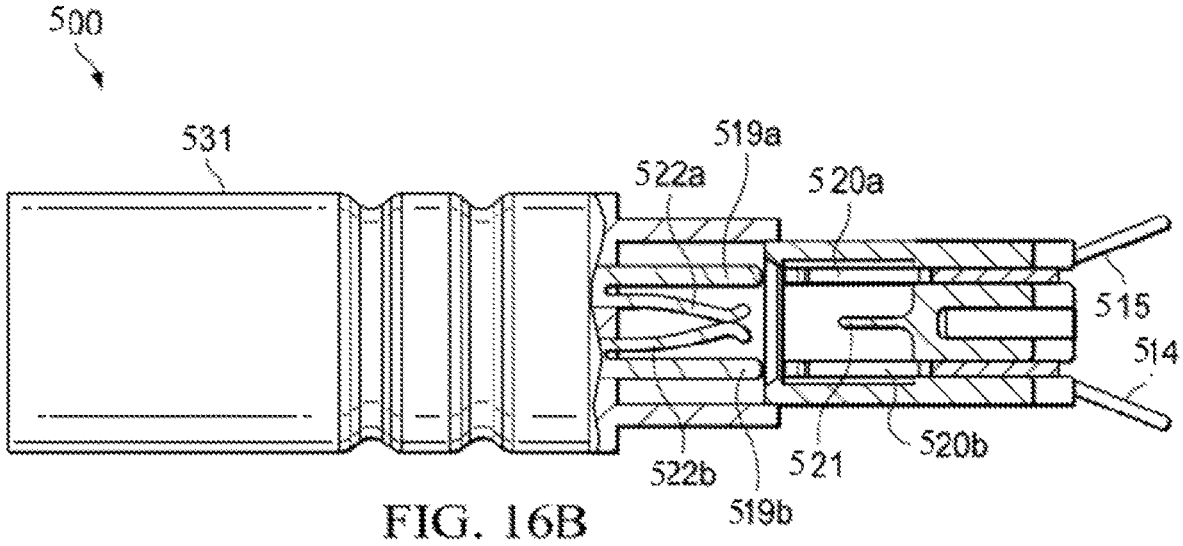
FIG. 16B shows a top cross section of a modular connector assembly.

Referring to FIGS. 16A, 16B, 16C, 16D, 16E, and 16F a side cross section and corresponding side cross section of the modular connector assembly 500 are shown in different stages of engagement. A modular connector assembly 500 has a receptacle 512 having contacts 520 are coupled to the connector 513. Connector 513 includes contact blades 519 that engage with the contacts 520. The contact blades 519 are further coupled to the resistors 517*a* and 517*b* via resister leads 518. Stage 1 is depicted by FIGS. 16A and 16B. In stage 1 the receptacle 512 is partially inserted into the connector 513, approximately one-third or less of the way inserted, there is no electrical connection between the receptacle 512 and connector 513 and the shunt, represented by shunt contacts 522*a* and 522*b*, are in the shunted position. In this configuration the modular connector assembly 500 is self-protected from radio frequency signals and stray voltages. As can be seen in FIG. 16B, the shunt contacts 522*a* and 522*b* are electrically in contact with each other, forming an electrical shunt between contact blades 519*a* and 519*b*. A latch may be used in this configuration to ensure a positive and locking engagement, but it is not shown. The signal contacts 520*a* and 520*b* are not engaged with the corresponding blades 519*a* and 519*b*. Therefore, the wires 514 and 515 are not connected. The separator 521, a non-conductive part of the receptacle 512, is not engaged with the shunt contacts 522*a* and 522*b*. Housing 531 is coupled to connector 513.

Figure 16C:
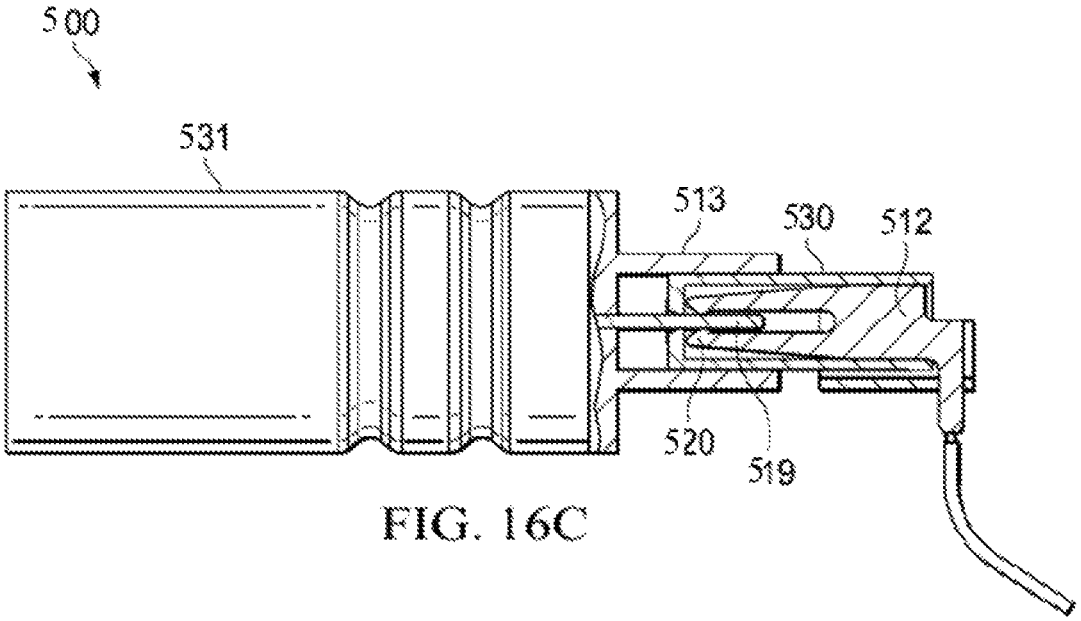
FIG. 16C shows a side cross section of a modular connector assembly.
Figure 16D:
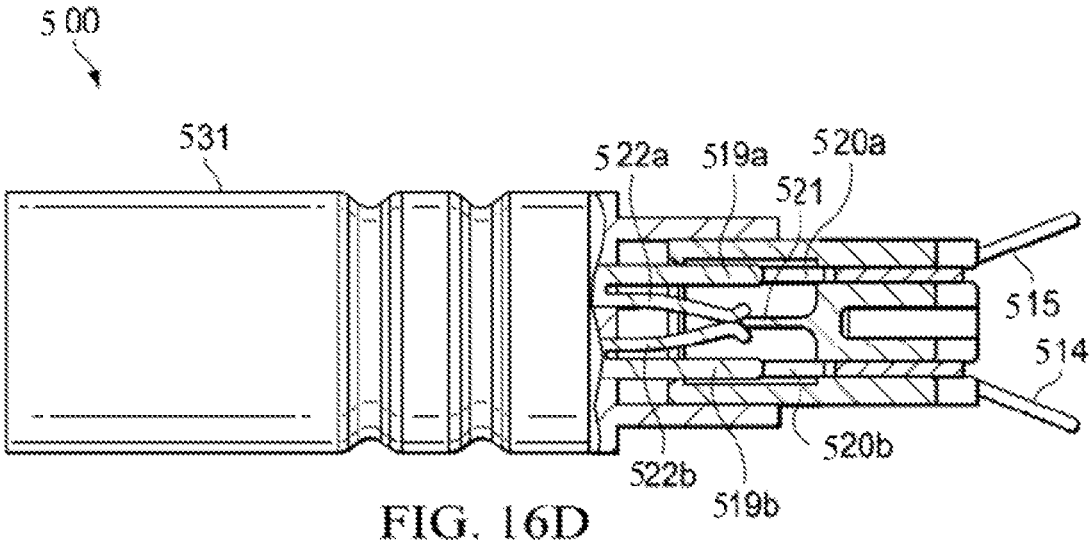
FIG. 16D shows a top cross section of a modular connector assembly.

Stage 2 is depicted in FIGS. 16C and 16D when the receptacle 512 is approximately between one third and two thirds of the way inserted into the connector 513. Here electrical connections have been established between the receptacle 512 and the connector 513 while the shunt remains in place due to shunt contacts 522*a* and 522*b* still being in contact. In this state the modular connector assembly 500 is electrically protected by the initiator shunt and the circuit connected to the receptacle and is in a transition state. As can be seen in FIG. 16D, the shunt contacts 522*a* and 522*b* are electrically in contact with each other, forming an electrical shunt between contact blades 519*a* and 519*b*. The signal contacts 520*a* and 520*b* are engaged with the corresponding blades 519*a* and 519*b*, however, because of the shunting, the signal contacts 520*a* and 520*b*, and their corresponding wires 514 and 515, are connected. The separator 521, is beginning to make contact with the shunt contacts 522*a* and 522*b*, but it has not yet separated them.

Figure 16E:
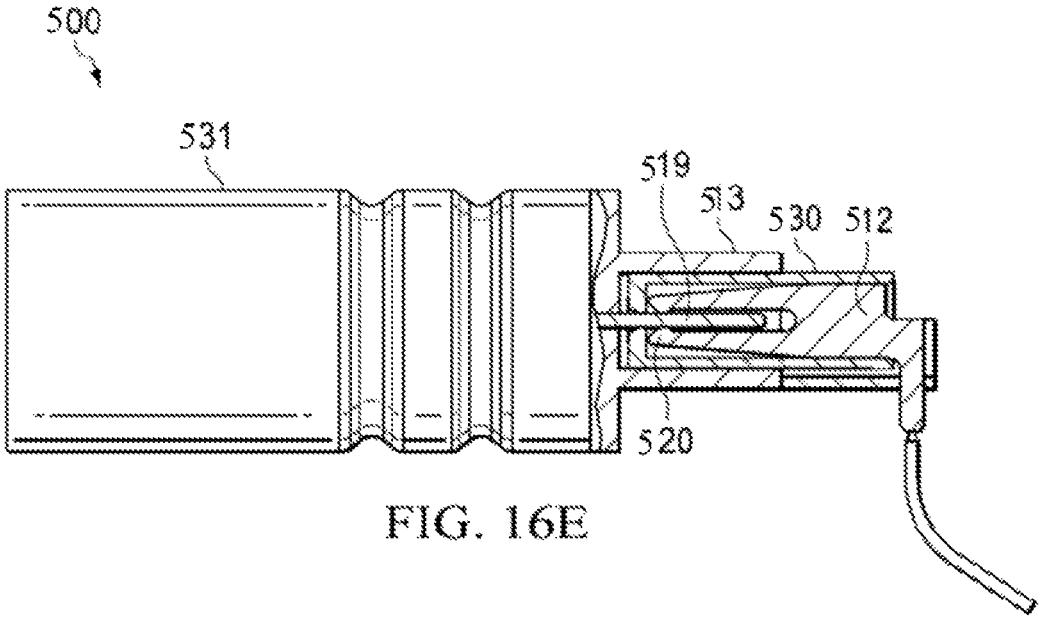
FIG. 16E shows a side cross section of a modular connector assembly.
Figure 16F:
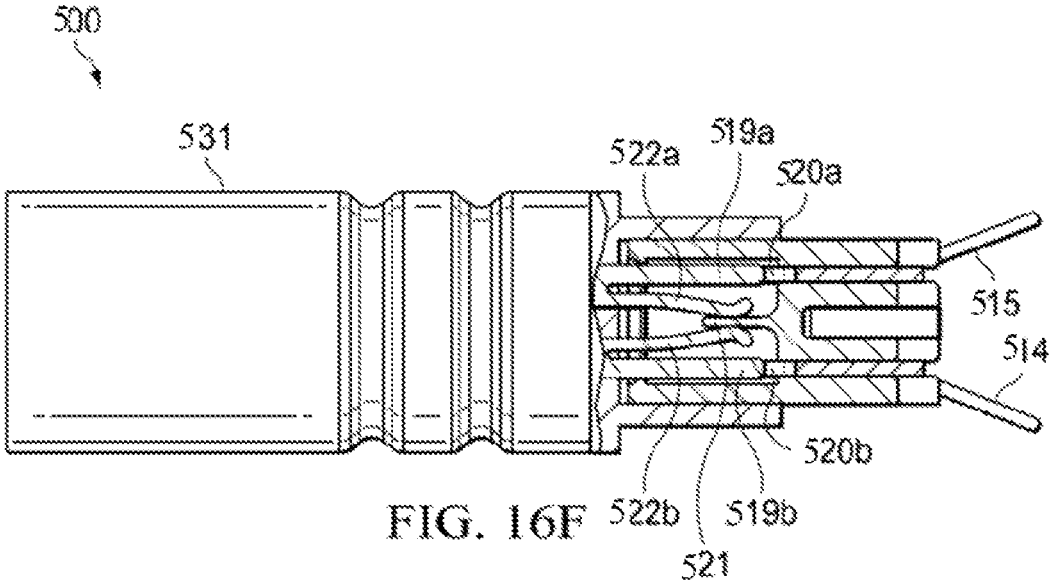
FIG. 16F shows a top cross section of a modular connector assembly.

Stage 3 is depicted in FIGS. 16E and 16F when the receptacle 512 is more than two thirds of the way inserted into connector 513. The receptacle 512 is in electrical communication with the connector 513 and is no longer shunted. As can be seen in FIG. 16F, the shunt contacts 522*a* and 522*b* are not electrically in contact with each other due to separator 521 wedging them apart, therefore contact blades 519*a* and 519*b* are unshunted, and thus wires 514 and 515 are no longer in contact with each other. The signal contacts 520*a* and 520*b* are engaged with the corresponding blades 519*a* and 519*b*.

Figure 17A:
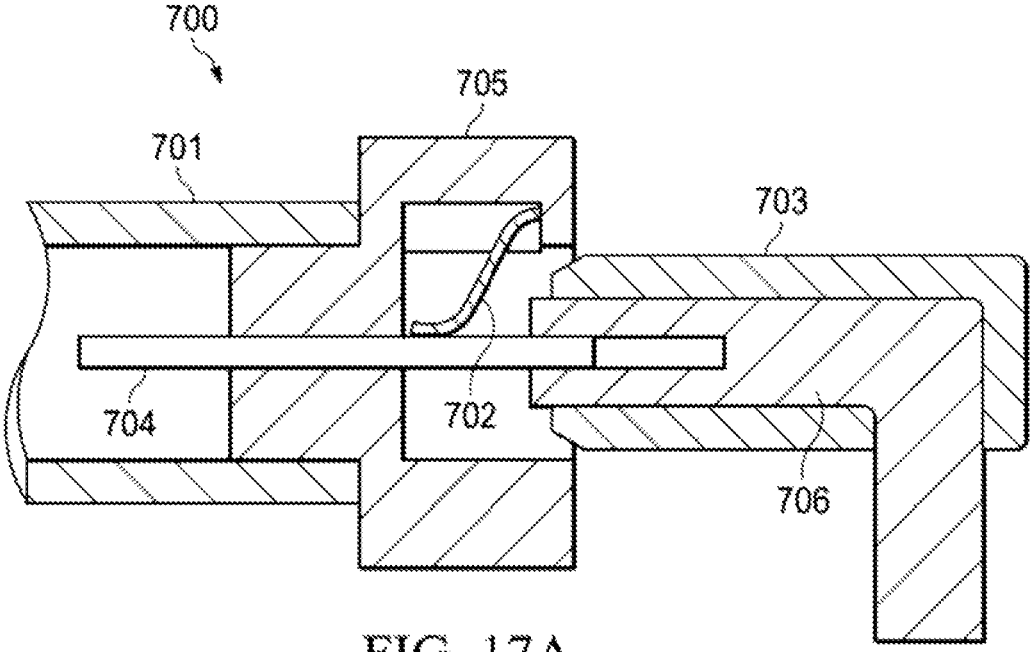
FIG. 17A shows a cross section of a partially inserted shunt and initiator connection.
Figure 17B:
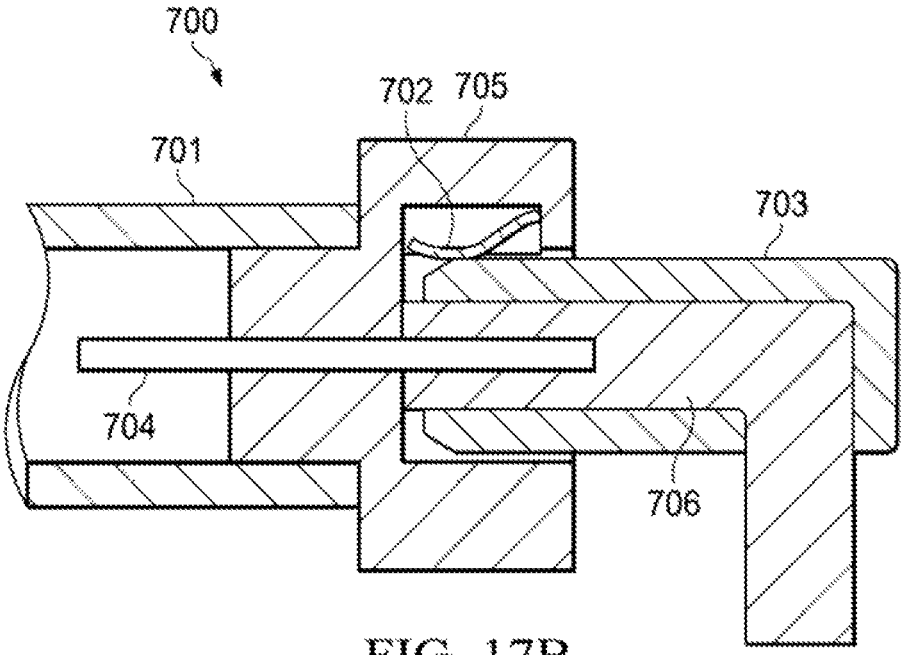
FIG. 17B shows a cross section of a fully inserted shunt and initiator connection.

An example embodiment of a shunting initiator connection may include modular connector assembly 700 with contact circuit is shown in FIGS. 17A and 17B. It has a detonator shell 701, a short/shunt tab 702, a shunt lift mechanism 703, an electrical contact pin 704, a connector housing 705, and an electrical contact circuit 706. There may be a plurality of pins 704 that are shunted by a single short/shunt tab 702. FIG. 17A shows an example where the modular connector assembly 700 is partially inserted and FIG. 17B shows an example where the modular connector assembly 700 is fully inserted.

Figure 18:
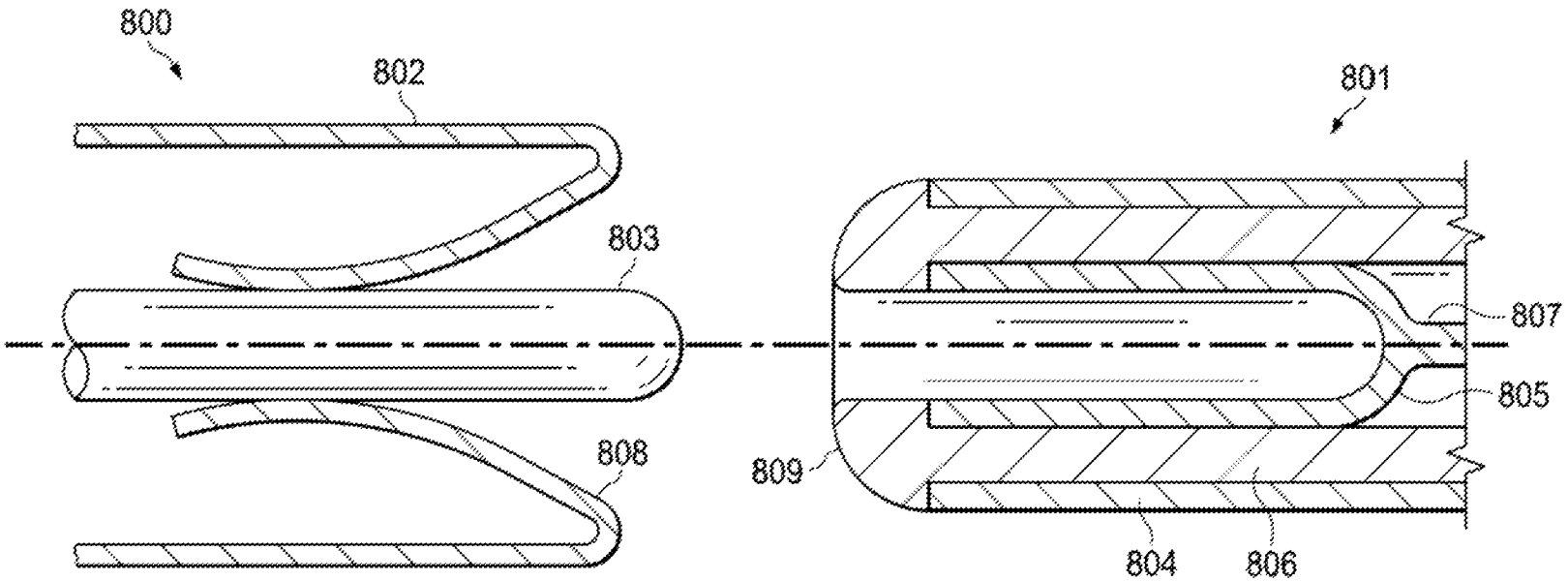
FIG. 18 shows a cross section view of a self-shunting coaxial male and female connector.

An example embodiment of a self-shunting coaxial connector is shown in FIG. 18. A coaxial male connector 800 has an electrically conductive line 803, it may be coupled to a positive wire, and an outer electrically conductive spring contact 802, that may be coupled to a negative wire. The spring contact 802 is by default in contact with line 803 due to a springing action, which provides a self-shunting feature for the male connector 800. The female connector 801 has an outer electrically conductive radial portion 804, a radial insulator 806, and an inner receptacle 805 that is electrically conductive. Inner receptacle 805 is coupled to a line 807. When the male connector 800 is initially inserted into the female connector 800, the spring contact 802 makes electrical contact with the radial portion 804 and the line 803 makes electrical contact with the receptacle 805. The curvature 808 of the spring contact 902 interfacing with the curvature 809 of the female connector forces the spring contact 802 away from the line 803 as the male connector 800 is fully inserted into the female connector 801, thus removing the shunt after first establishing electrical contact.

Wireless detonator, as used in this specification, is defined as a detonator that is pre-wired prior to installation and does not require any wiring in the field to function. This wireless capability allows the detonator to become effectively a plug-and-play device that establishes the necessary electrical connections for its function by plugging it into the perforating gun.

The example embodiments disclose a modular gun system that is a box by pin design consisting of a steel loading tube with an end fitting pre-installed at each end. One end fitting centers and orients the loading tube and embodies a selective switch, feed through contact and orifices to insert a wireless detonator from the outer end and detonating cord into the inner end.

The loading tube is pre-wired with insulated wire which is terminated at the selective switch in one end fitting and the pressure bulkhead at the opposite end. The opposite end fitting centers the loading tube and provides electrical contact from the pre-installed insulated wire on the loading tube to the pressure bulkhead contact adjacent to the end fitting. The pressure bulkhead is pre-installed into a baffle in the pin end of the gun carrier. The selective switch is grounded to the loading tube which is electrically connected to the baffle which is threaded into the gun carrier.

Charges are inserted into the loading tube and held in place by locking features fixed to the shaped charge. Detonating cord is inserted into the back of each charge via locking features fixed to the shaped charge. The detonating cord terminates into the detonating cord orifice in the end fitting. A wireless detonator is inserted into the end fitting from outside of the gun assembly such that the explosive load end of the detonator is adjacent to the detonating cord in an end to end position. The wireless detonator has an auto-shunting feature that does not un-shunt until a mating receptacle is inserted.

The selective switch has a ribbon pigtail with the un-shunting receptacle attached. After inserting the wireless detonator, the connector receptacle connected to the switch is attached to the end of the detonator, disengaging the shunt of the detonator. The loaded and armed modular gun assemblies are screwed together such that the top contact makes electrical contact to the bottom contact of the adjacent gun assembly. The box by pin gun configuration is accomplished by swaging and threading the outer diameter of one end of the gun. Alternatively, the pin end is accomplished by installing a pin by pin tandem sub into one box end of a box by box gun body.

The end fitting is purposefully designed via a mold or machining method to house a selective switch designed to selectively initiate the detonator of a perforating gun. The end fitting is pre-assembled with a spring-loaded top contact wired to the input of the selective switch. The end fitting is pre-assembled such that the through wire of the selective switch is connected to the insulated wire pre-installed onto the loading tube. The end fitting is pre-assembled such that the output wires of the selective switch are insulated ribbon or wires which has the detonator connector receptacle affixed to its end. The end fitting is purposefully designed via a mold or machining method to insert detonating cord through the inner end and a detonator from the outer end such that the detonator is adjacent to the detonating cord on the horizontal axis of the gun body. Alternatively, the end fitting is designed such that the detonating cord and detonator overlap each other such that the end of the detonating cord and detonator are side by side.

The pressure bulkhead is pre-installed into the baffle of the pin end of the gun carrier. Alternatively, the pressure bulkhead is pre-installed into the pin by pin tandem sub which is inserted into one end of the gun carrier. Alternatively, the pressure bulkhead is pre-installed to the end of the charge tube end fitting. The gun assembly is armed by inserting a wireless electric detonator, connector end facing up, into the end fitting detonator orifice, followed by attaching the connector receptacle attached to the end fitting into the outer end of the detonator.

The selective switch is attached to, or contained within, the pre-wired loading tube and the wires with the detonator connector receptacle pass through the upper end fitting. The selective switch is contained within the lower end fitting, wherein the insulated wire is connected to the switch within the same lower end fitting and the detonator connector receptacle wire runs the length of the loading tube and the receptacle end passes through the upper end fitting.

The application for the example embodiments may be used with different types of initiators including resistor based bridgewire initiators, exploding bridge wire initiators, exploding foil initiators, and any other style of electric or electronic initiator. The modular initiator in the example embodiment is a packaged unit, which may include resistors, capacitors, or other electrical components. It may include a circuit board or other electronic circuitry. The modular initiator may be assembled or incorporated into an electrical circuit as a new assembly. The modular initiator may function as a standalone unit. A contact assembly without electronic circuitry may be employed which would receive the initiator and pass through electrical signals to the initiator.

The modular initiator includes a shell containing a high explosive such as lead azide, RDX, HMX, HNS, a bridge element or foil initiator, and electrical components such as resistors, capacitors, spark gaps, electronic circuits, etc. The modular initiator may contain a rigid connector. The rigid connector may be incorporated in many configurations. The rigid connector may be a male pin-style or female style socket. The connector may incorporate a shunting mechanism. The purpose of the shunting mechanism is to act as a protective barrier against radio frequency (RF) energy and stray electrical energy by electrically shorting the contacts. The short length and removal of leg wires also creates RF resistance. The modular initiator must be protected from RF when transported off-site on public roads. The modular initiator could be installed to an electronic circuit with its own RF protection during the installation process. For situations where the shunt must be removed, a safety housing can be employed to protect personnel if the modular initiator were to initiate during installation. Robotics installation methods could also be used when shunting is not available.

Auto-Shunting Electrical Connection or Auto-Shorting Electrical Connection (ASEC)—An ASEC is an electrical connection comprising at least one connector with a self-contained feature which electrically shorts two or more electrical contact paths of the connector when the connector is disconnected from, in the process of being disconnected from, or is being connected to a mating connector which includes at least one design feature which disengages the shorting feature of the first connector after electrical contact is established or allows the shorting feature of the first connector to reengage before electrical contact is broken.

Auto-Shunting Electric Initiator or Auto-Shorting Electric Detonator (ASED)—An ASED is an electric or electronic initiator of any variety in which electrical energy is converted to an high energy output wherein the electric or electronic initiator includes the attached connector of an ASEC with the self-contained feature to electrically short two or more electrical contact paths and the electrical contact paths of the ASEC connector include the electrical contact paths of the electric or electronic initiator and at least part of the path through which electrical energy is converted to a high energy output.

Initiators may be used to initiate a perforating gun, a cutter, a setting tool, or other downhole energetic device. For example, a cutter is used to cut tubulars with focused energy. A setting tool uses a pyrotechnic to develop gases to perform work in downhole tools. Any downhole device that uses an initiator may be adapted to use the modular connector assembly disclosed herein.

Although the invention has been described in terms of embodiments which are set forth in detail, it should be understood that this is by illustration only and that the invention is not necessarily limited thereto. For example, terms such as upper and lower or top and bottom can be substituted with uphole and downhole, respectfully. Top and bottom could be left and right, respectively. Uphole and downhole could be shown in figures as left and right, respectively, or top and bottom, respectively. Generally downhole tools initially enter the borehole in a vertical orientation, but since some boreholes end up horizontal, the orientation of the tool may change. In that case downhole, lower, or bottom is generally a component in the tool string that enters the borehole before a component referred to as uphole, upper, or top, relatively speaking. The first housing and second housing may be top housing and bottom housing, respectfully. In a gun string such as described herein, the first gun may be the uphole gun or the downhole gun, same for the second gun, and the uphole or downhole references can be swapped as they are merely used to describe the location relationship of the various components. Terms like wellbore, borehole, well, bore, oil well, and other alternatives may be used synonymously. Terms like tool string, tool, perforating gun string, gun string, or downhole tools, and other alternatives may be used synonymously. The alternative embodiments and operating techniques will become apparent to those of ordinary skill in the art in view of the present disclosure. Accordingly, modifications of the invention are contemplated which may be made without departing from the spirit of the claimed invention.

What is claimed is:

1. A perforating gun system comprising:

a cylindrical housing with a bottom end and a top end;

a prewired loading tube assembly disposed within the cylindrical housing and having a corresponding bottom end and top end;

an upper end fitting having a door for receiving a detonator and securing it into a recess coupled to the top end of the prewired loading tube and the top end of the cylindrical housing;

a lower end fitting coupled to the bottom end of the prewired loading tube and the bottom end of the cylindrical housing;

upper electrical connections coupled to the upper end fitting;

lower electrical connections coupled to the bottom end fitting;

a selective switch coupled to a detonator connector receptacle disposed within the upper end fitting;

a baffle coupled to the bottom end of the cylindrical housing, wherein the loading tube is electrically connected to the baffle; and a detonator electrically coupled to the selective switch and further disposed within the door of the upped end fitting.

2. The prewired loading tube assembly of claim 1, wherein the upper end fitting disposed within the pre-wired loading tube houses a selective switch wherein the end fitting contains a portion to receive an auto-shunting modular detonator by electrically connecting it to a mating receptacle of a selective switch and affixing the auto-shunting modular detonator proximate to a detonating cord.

3. The perforating gun system of claim 1, further comprising a means for auto-shunting the detonator.

4. The perforating gun system of claim 1, wherein the prewired loading tube further comprises an insulated wire which is terminated at the selective switch in the upper end and a pressure bulkhead coupled to the lower end.

5. The perforating gun system of claim 1, wherein the selective switch is grounded to the loading tube.

6. The perforating gun system of claim 1, further including shaped charges installed into the loading tube, wherein the shaped charges are held in place by a locking means fixed to the shaped charge.

7. The perforating gun system of claim 6, further comprising a detonating cord coupled to the back of the shaped charges with a detonating cord locking means.

8. The perforating gun system of claim 7, wherein the detonating cord terminates into a detonating cord orifice integral with the end fitting.

9. The perforating gun system of claim 8, wherein the detonator is located adjacent to the detonating cord in an end-to-end configuration.

10. The perforating gun system of claim 1, wherein the detonator has an auto-shunting feature that does not unshunt until a mating receptacle is inserted.

11. The perforating gun system of claim 10, wherein the selective switch has a ribbon pigtail with the un-shunting receptacle attached.

12. The perforating gun system of claim 11, wherein the receptacle connected to the switch is attached to the end of the detonator, disengaging the shunt of the detonator.

13. A pre-wired shaped charge loading tube assembly comprising:

a cylindrical housing with a bottom end and a top end;

an upper end fitting having a door for electrically receiving a detonator and securing it into a recess coupled to the top end of the prewired loading tube and the top end of the cylindrical housing;

a lower end fitting coupled to the bottom end of the prewired loading tube and the bottom end of the cylindrical housing;

upper electrical connections coupled to the upper end fitting;

lower electrical connections coupled to the bottom end fitting;

a selective switch coupled to a detonator connector receptacle disposed within the upper end fitting; and a detonator electrically coupled to the selective switch and further disposed within the door closed into the recess of the upper end fitting, wherein the upper end fitting disposed within the pre-wired loading tube houses the selective switch wherein the end fitting contains a portion to receive an auto-shunting modular detonator by electrically connecting the portion to a mating receptacle of the selective switch and affixing the auto-shunting modular detonator proximate to a detonating cord.

14. The pre-wired shaped charge loading tube assembly of claim 13, further comprising a means for auto-shunting the detonator.

15. The pre-wired shaped charge loading tube assembly of claim 13, further including coupling a baffle to the bottom end of the cylindrical housing.

16. The pre-wired shaped charge loading tube assembly of claim 15, wherein the selective switch is grounded to the loading tube.

17. The pre-wired shaped charge loading tube assembly of claim 16, wherein the loading tube is electrically connected to the baffle.

18. The pre-wired shaped charge loading tube assembly of claim 13, wherein the prewired loading tube further comprises an insulated wire which is terminated at the selective switch in the upper end and a pressure bulkhead coupled to the lower end.

19. The pre-wired shaped charge loading tube assembly of claim 13, further including shaped charges installed into the loading tube, wherein the shaped charges are held in place by a locking means fixed to the shaped charge.

20. The pre-wired shaped charge loading tube assembly of claim 19, further comprising a detonating cord coupled to the back of the shaped charges with a detonating cord locking means.

21. The pre-wired shaped charge loading tube assembly of claim 20, wherein the detonating cord terminates into a detonating cord orifice integral with the end fitting.

22. The pre-wired shaped charge loading tube assembly of claim 21, wherein the detonator is located adjacent to the detonating cord in an end-to-end configuration.

23. The pre-wired shaped charge loading tube assembly of claim 13, wherein the detonator has an auto-shunting feature that does not un-shunt until a mating receptacle is inserted.

24. The pre-wired shaped charge loading tube assembly of claim 23, wherein the selective switch has a ribbon pigtail with the un-shunting receptacle attached.

25. The pre-wired shaped charge loading tube assembly of claim 24, wherein the receptacle connected to the switch is attached to the end of the detonator, disengaging the shunt of the detonator.

26. A method of perforating a wellbore comprising:

coupling a pre-wired first end fitting with a first end of a shaped charge loading tube;

coupling a pressure bulkhead at the first end fitting and the first end of the shaped charge loading tube;

coupling a pre-wired second end fitting with a second end of a shaped charge loading tube, wherein the second end fitting centers and orients the loading tube and embodies a selective switch, feed through contact and orifices to insert a wireless detonator from the outer end and detonating cord into the inner end;

inserting a detonator into a door incorporated into end fitting and closing the door into a recess of the end fitting such that the explosive end of the detonator is adjacent to the detonating cord in a side-by-side configuration; and pre-wiring the loading tube with insulated wire, wherein the wire terminates at the selective switch in the second end fitting and the pressure bulkhead at the first end fitting.

27. The method of claim 26, further comprising centering the loading tube using the first end fitting within a perforating gun body.

28. The method of claim 26, further comprising electrically contacting the pre-installed insulated wire disposed within the loading tube to the pressure bulkhead contact adjacent.

29. The method of claim 26, further comprising pre-installing a baffle in a pin end of a gun carrier.

30. The method of claim 26, further comprising grounding the selective switch to the shaped charge loading tube.

31. The method of claim 26, further comprising inserting the shaped charges into the shaped charge loading tube.

32. The method of claim 31, further comprising locking the shaped charges into place within the shaped charge loading tube.

33. The method of claim 26 further comprising inserting detonating cord into the back of each shaped charge disposed within the shaped charge loading tube via locking features fixed to the shaped charge.

34. The method of claim 26 further comprising inserting the termination of a detonating cord into the end fitting.

35. The method of claim 34, wherein the wireless detonator has an auto-shunting feature that does not un-shunt until a mating receptacle is inserted.

36. The method of claim 35, wherein the selective switch has a ribbon pigtail with the un-shunting receptacle attached.

37. The method of claim 36, further comprising inserting the wireless detonator wherein the connector receptacle connected to the switch is attached to the end of the detonator, disengaging the shunt of the detonator.

38. The method of claim 26, further comprising screwing together a loaded perforating modular gun assemblies wherein a top contact makes electrical contact to a bottom contact of the adjacent gun assembly.

39. The method of claim 26, further comprising swaging and threading the outer diameter of a pin end of a perforating gun.

40. The method of claim 26, further comprising installing a pin by pin tandem sub into a box end of perforating gun assembly having a box by box gun body.

41. The method of claim 26, further comprising selectively initiating the detonator of a perforating gun.

42. The method of claim 26, further comprising pre-assembling spring-loaded top contact wires coupled to the selective switch.

43. The method of claim 26, further comprising connecting the through wire of the selective switch to the insulated wire of the loading tube.

44. The method of claim 26, wherein the output wires of the selective switch are insulated ribbon or wires which has the detonator connector receptacle affixed to its end.

45. The method of claim 26, further comprising inserting the detonating cord through the inner end of the end fitting and a detonator from the outer end such that the detonator is adjacent to the detonating cord on a horizontal axis of a gun body.

46. The method of claim 26, further comprising overlapping the detonating cord and the detonator to form a side by side explosive coupling.

47. The method of claim 26, further comprising installing the pressure bulkhead into a baffle of a pin end of a gun carrier.

48. The method of claim 26, further comprising coupling the pressure bulkhead into a pin-by-pin tandem sub, wherein the tandem sub is inserted into a first end of the gun carrier.

49. The method of claim 26, further comprising coupling the pressure bulkhead into a second end of the gun carrier.

50. The method of claim 26, further comprising arming the perforating gun by inserting a wireless electric detonator, connector end facing up, into a end fitting detonator orifice.

51. The method of claim 26, further comprising attaching the selective switch to the pre-wired loading tube and wiring a detonator connector receptacle pass through to the upper end fitting.

52. The method of claim 26, further comprising connecting the insulated wire to the switch within the lower end fitting, wherein a detonator connector receptacle wire runs a length of the loading tube and a receptacle end passes through the upper end fitting.

* * * * *